US006926647B1

(12) United States Patent
Huang et al.

(10) Patent No.: US 6,926,647 B1
(45) Date of Patent: Aug. 9, 2005

(54) FOLDING COLLAPSIBLE ROWING MACHINE

(75) Inventors: Chin-Lien Huang, Taoyuan Hsien (TW); Johnson Kuo, Taipei (TW)

(73) Assignee: Johnson KUO, Taipei (TW)

( * ) Notice: Subject to any disclaimer, the term of this patent is extended or adjusted under 35 U.S.C. 154(b) by 232 days.

(21) Appl. No.: 10/449,102

(22) Filed: Jun. 2, 2003

(51) Int. Cl.[7] ..... A63B 69/06; A63B 21/055; A63B 21/012

(52) U.S. Cl. ..... 482/72; 482/115; 482/130; 482/138; 482/145

(58) Field of Search ..... 482/72, 145, 115, 482/130, 138

(56) References Cited

U.S. PATENT DOCUMENTS 5,295,931 A * 3/1994 Dreibelbis et al. ..... 482/72
5,899,836 A * 5/1999 Chen ..... 482/92
6,093,135 A * 7/2000 Huang ..... 482/72
6,152,866 A * 11/2000 Kuo ..... 482/142
6,817,968 B2 * 11/2004 Galbraith et al. ..... 482/72

* cited by examiner

*Primary Examiner*—Jerome W. Donnelly
*Assistant Examiner*—Victor K. Hwang
(74) *Attorney, Agent, or Firm*—Troxell Law Office, PLLC

(57) ABSTRACT

A folding collapsible rowing machine is constructed to include a folding collapsible base frame equipped with a foot frame at the front side, a sliding seat horizontally slidably supported on the main shaft of the base frame, a rocker fastened pivotally with the main shaft of the base frame in front of the sliding seat, elastic cord members connected between the front end of the main shaft of the base frame and the sliding seat, and a friction wheel block unit coupled between the sliding seat and the rocket and adapted to impart a resisting force to the user.

4 Claims, 31 Drawing Sheets

FOLDING COLLAPSIBLE ROWING MACHINE

BACKGROUND AND SUMMARY OF THE INVENTION

The present invention relates to rowing machines and, more particularly, to a folding collapsible rowing machine, which can be operated in one of a number of operation modes to exercise the muscles of different parts of the body.

FIG. 1 is an elevational view of a conventional rowing machine. This design of rowing machine is functional, however it still has drawbacks. When not in use, this design of rowing machine requires much storage space. Further, this design of rowing machine provides only one operation mode, i.e., the rowing action only.

The present invention has been accomplished to provide a rowing machine, which eliminates the aforesaid drawbacks. It is one object of the present invention to provide a rowing machine, which is folding collapsible. It is another object of the present invention to provide a rowing machine, which provides a number of operation modes for enabling the user to exercise the muscles of different parts of the body. According to one aspect of the present invention, the folding collapsible rowing machine comprises a folding collapsible base frame equipped with a foot frame at the front side, a sliding seat horizontally slidably supported on the main shaft of the base frame, a rocker fastened pivotally with the main shaft of the base frame in front of the sliding seat, elastic cord members connected between the front end of the main shaft of the base frame and the sliding seat, and a friction wheel block unit coupled between the sliding seat and the rocket and adapted to impart a resisting force to the user. According to another aspect of the present invention, elastic pull ropes can be selectively fastened to the front or rear support of the base frame or the foot frame for pulling by the user sitting on the sliding seat and resting the feet on the foot frame.

DETAILED DESCRIPTION OF THE INVENTION

Figure 1:
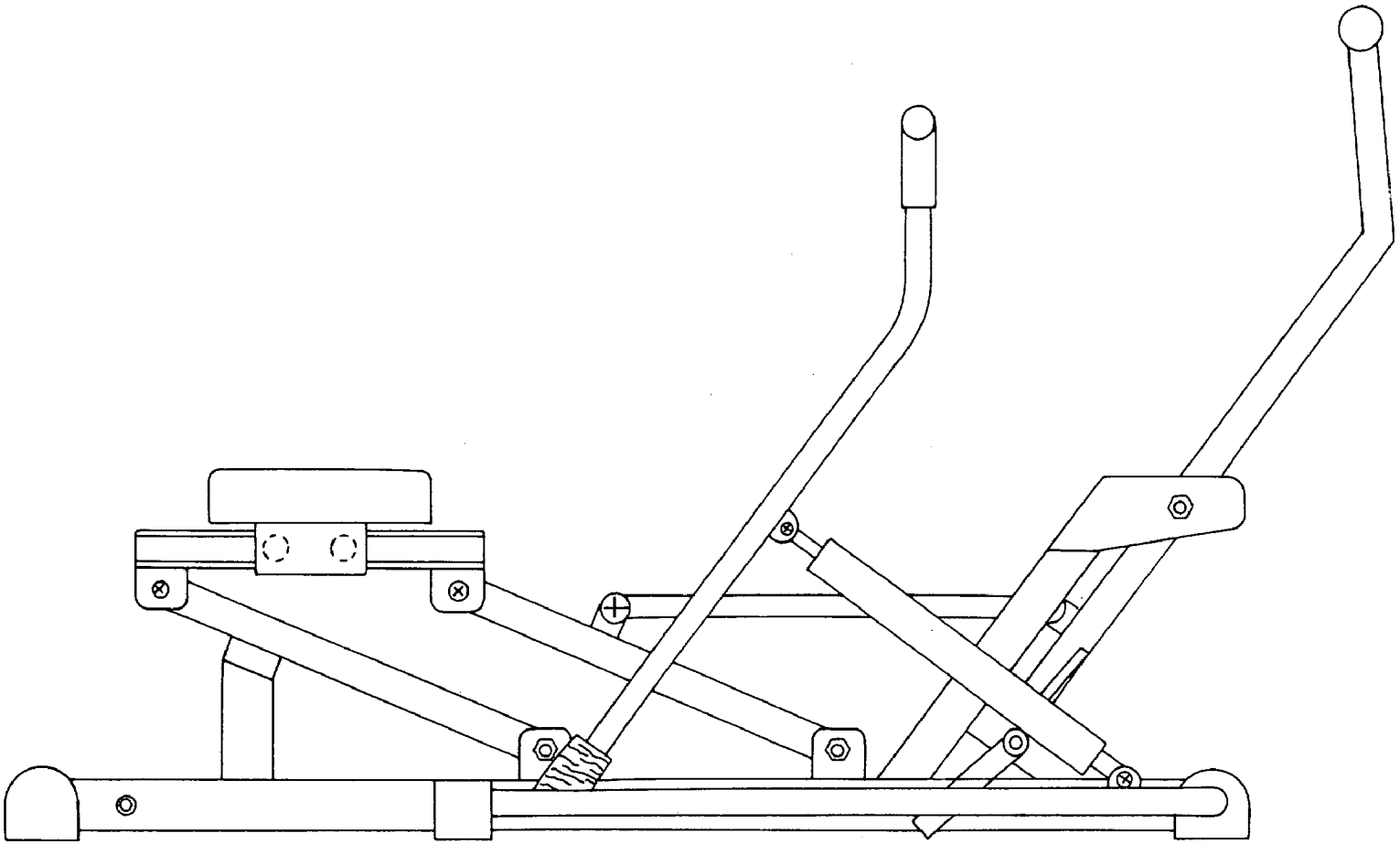
Fig. 1 PRIOR ART
FIG. 1 is an elevational view of a rowing machine according to the prior art.
Figure 2:
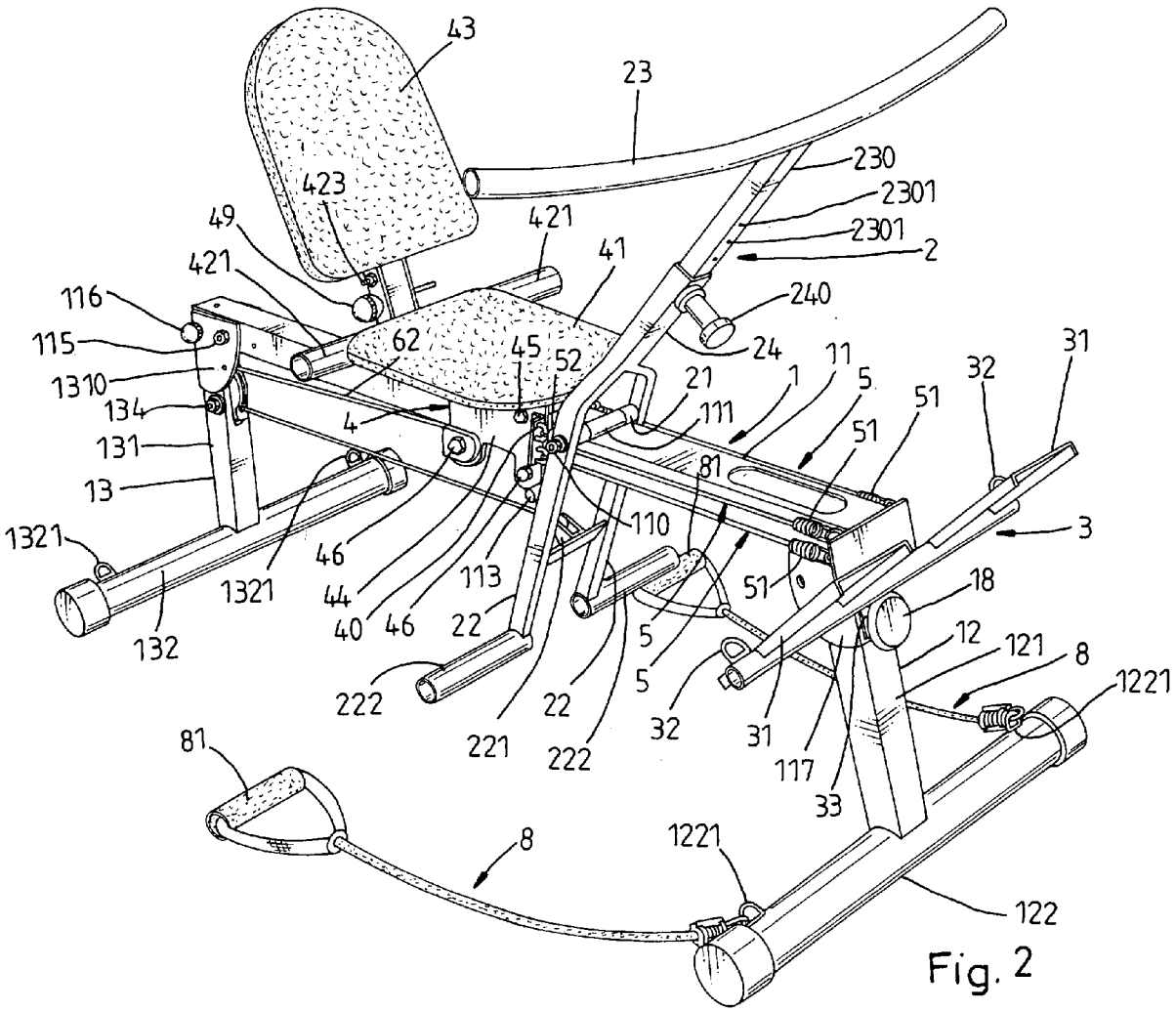
FIG. 2 is an elevational view of a folding collapsible rowing machine according to the present invention.

Referring to FIGS. 2~31, a rowing machine is shown generally comprised of a base frame 1, a rocker 2, a foot frame 3, a sliding seat 4, a plurality of elastic cord members 5, and a friction wheel block unit.

The base frame 1 comprises a main shaft 11, a front support 12, and a rear support 13. The front support 12 comprises a horizontal bottom bar 122, and a vertical top bar 121 perpendicularly upwardly extended from the horizontal bottom bar 122 on the middle and adapted to support one end of the main shaft 11. The horizontal bottom bar 122 has two eyes 1221 protruded from the periphery near two ends. The rear support 13 comprises a horizontal bottom bar 132, and a vertical top bar 131 perpendicularly upwardly extended from the horizontal bottom bar 132 on the middle and adapted to support the other end of the main shaft 11. The horizontal bottom bar 132 has two eyes 1321 protruded from the periphery near two ends. The vertical top bar 131 comprises an opening 133. The main shaft 11 comprises a barrel 111 transversely located on the top in front of the midpoint of the main shaft 11 for the coupling of the rocker 2, a transverse locating hole 112 transversely spaced behind the midpoint of the main shaft 11, a locating rod 113 mounted in the transverse locating hole 112 and adapted to support the rocker 2 when the rowing machine collapsed (see FIG. 8), a plurality of front eyes 114 symmetrically bilaterally provided at the front side above the front support 12 for the positioning of the elastic cord members 5.

Figure 6:
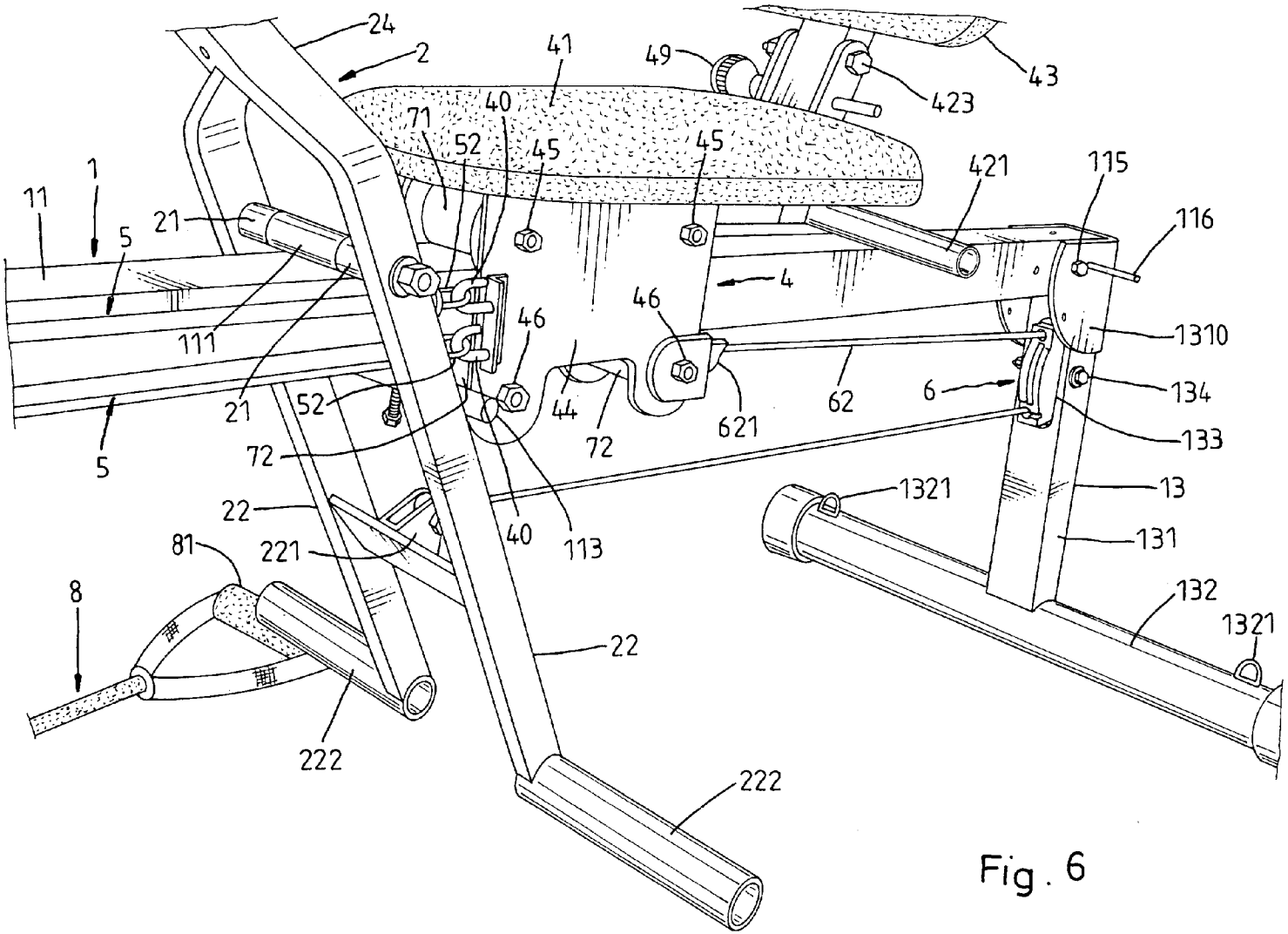
FIG. 6 is an enlarged view of a part of the present invention, showing the arrangement of the sliding seat and the rocker at the base frame.
Figure 7:
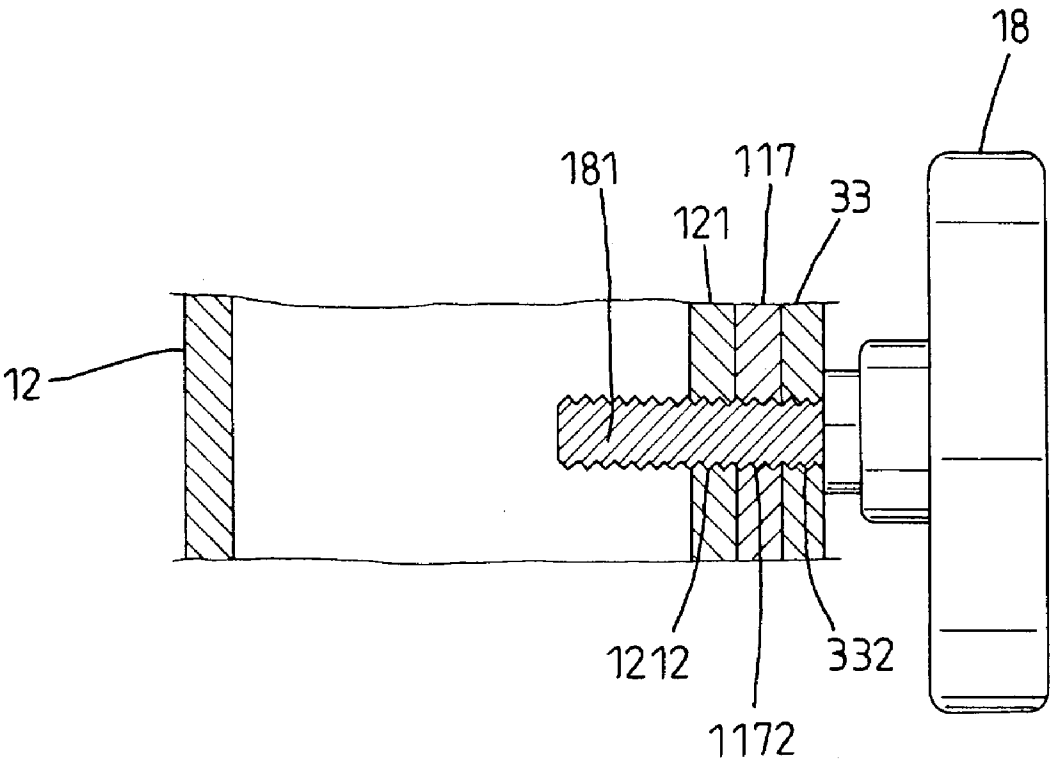
FIG. 7 is a sectional view in an enlarged scale of a part of the present invention, showing the positioning of the adjustment knob in the base frame.

The rocker 2 comprises a bottom fork 22, a transverse frame 221 transversely suspended in the bottom fork 22 and spaced below the main shaft 11 of the base frame 1, two barrels 21 aligned in the bottom fork 22 and pivotally connected to the two ends of the barrel 111 of the main shaft 11 by a pivot bolt 110, two foot bars 222 respectively outwardly extended from the two bottom ends of the bottom fork 22, and a handlebar 23 at the top side of the bottom fork 22 (see FIG. 6).

Figure 3:
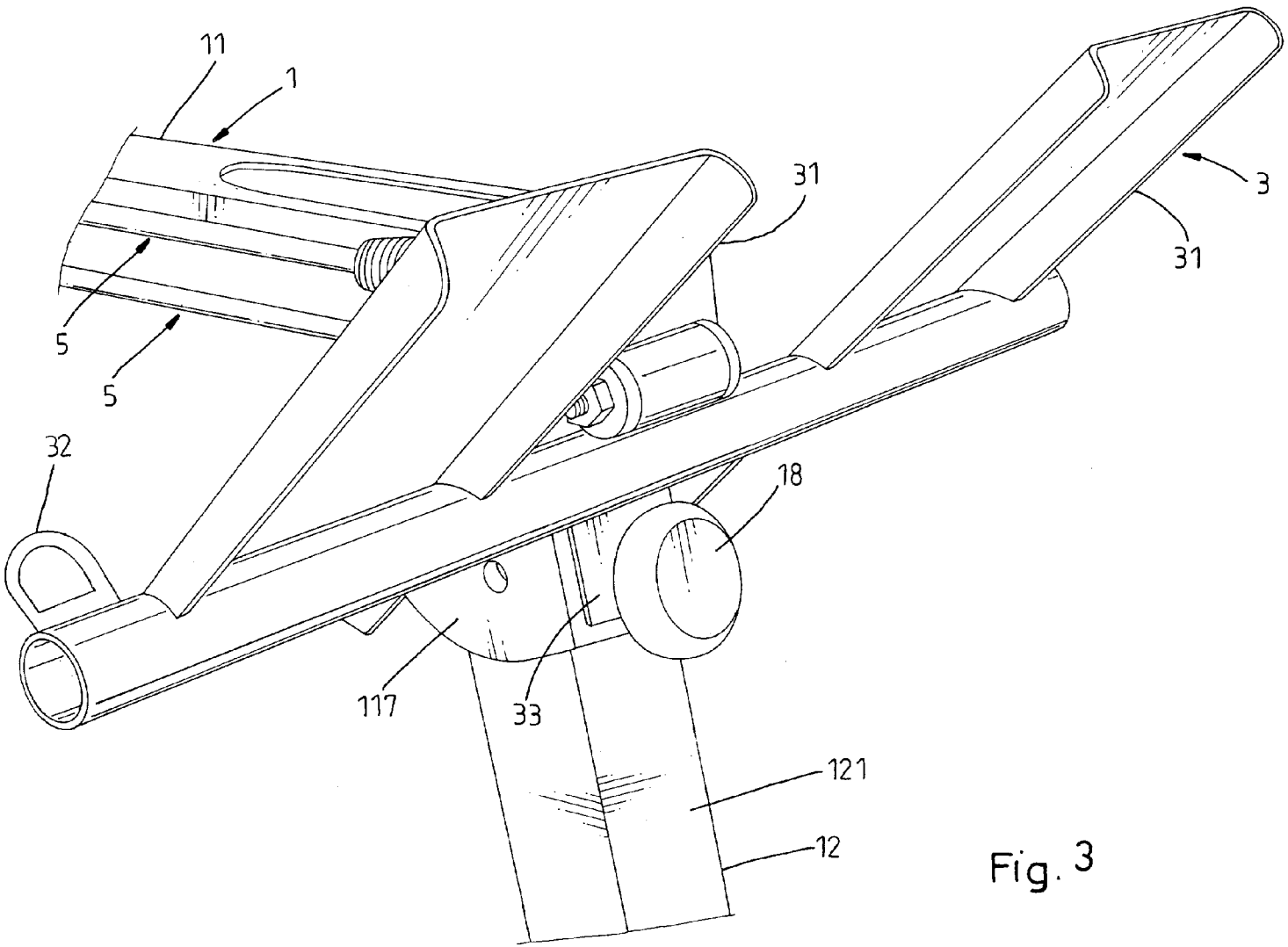
FIG. 3 is an enlarged view of a part of the present invention, showing the arrangement of the foot frame at the base frame.
Figure 4:
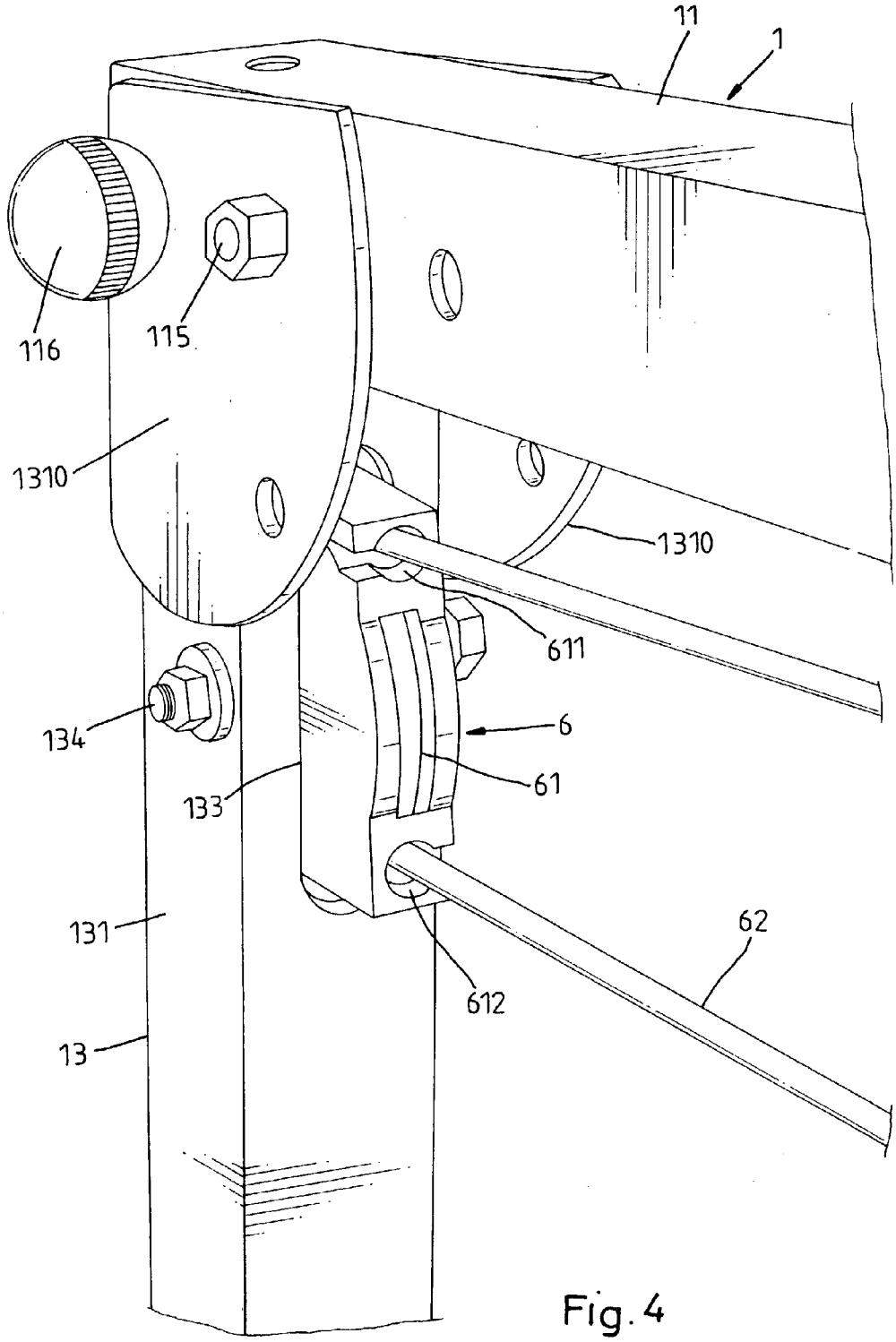
FIG. 4 is an enlarged view of a part of the present invention, showing the arrangement of the friction wheel block unit at the base frame.

The foot frame 3 is fixedly fastened to the vertical top bar 121 of the front support 12 near the top, having two footplates 31 and two eyes 32 symmetrically disposed at two sides (see FIG. 3).

Figure 5:
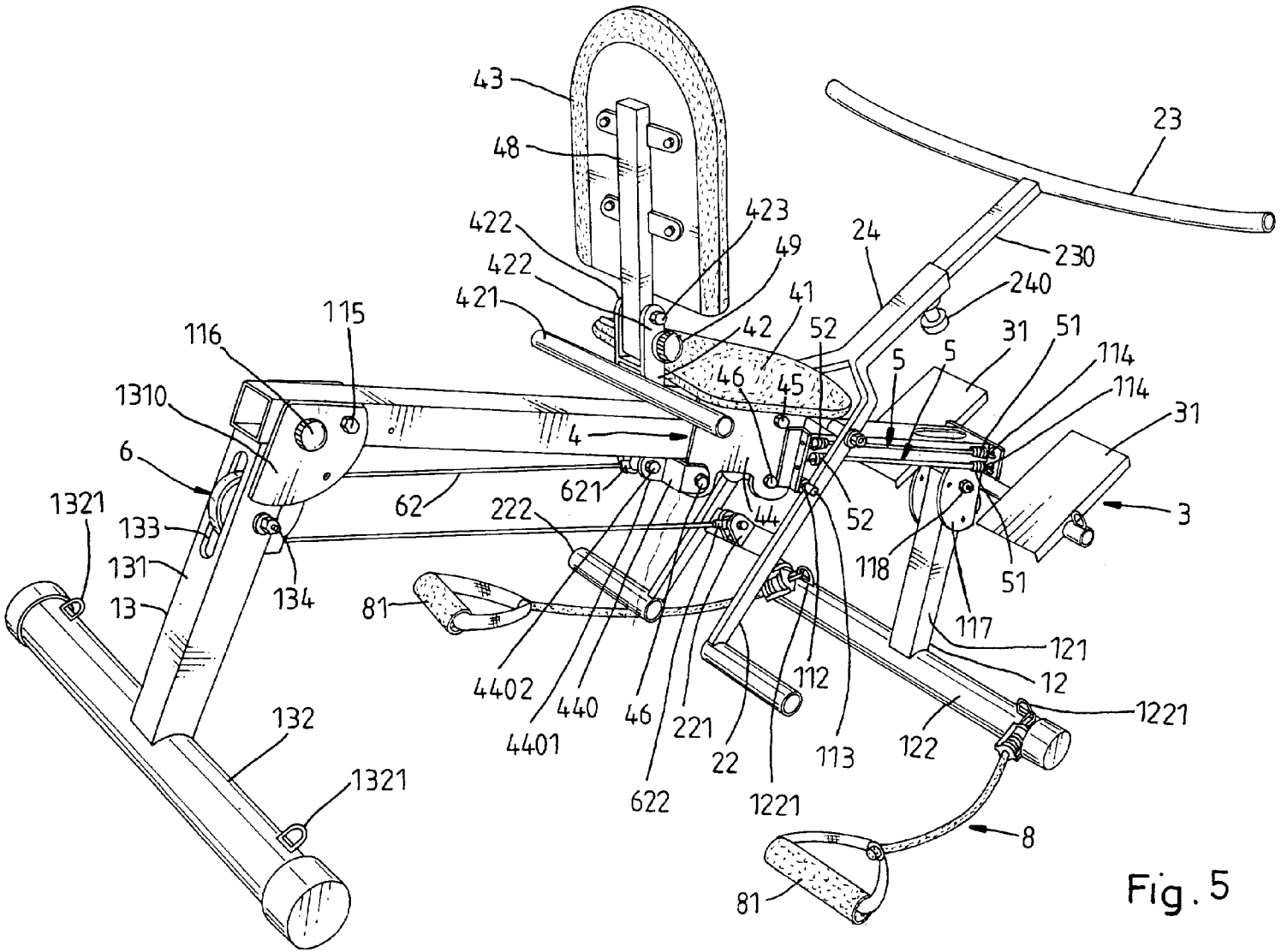
FIG. 5 is another elevational view of the folding collapsible rowing machine according to the present invention when viewed from another angle.

The sliding seat 4 comprises a seat frame 44, a plurality of rollers 71 and 72 symmetrically pivoted to the seat frame 44 by respective pivots 45 and 46 and rotatably supporting the seat frame 44 on the main shaft 11 of the base frame 1 for enabling the sliding seat 4 to be moved back and forth along the main shaft 11 of the base frame 1, a plurality of front eyes 40 at the front side of the seat frame 44 (see FIG. 6), a seat cushion 41 at the top of the seat frame 44 for sitting, a back frame 42 at the back side of the seat cushion 41, a back cushion 43 supported on the back frame 42 and adapted to support the back of the user sitting on the seat cushion 41, a horizontal handlebar 421 located on the bottom side of the back frame 42, and two lugs 440 at two sides of the seat frame 44, a pivot 4402 fastened to the respective coupling portion 4401 of the lugs 440 (see FIG. 5).

Figure 8:
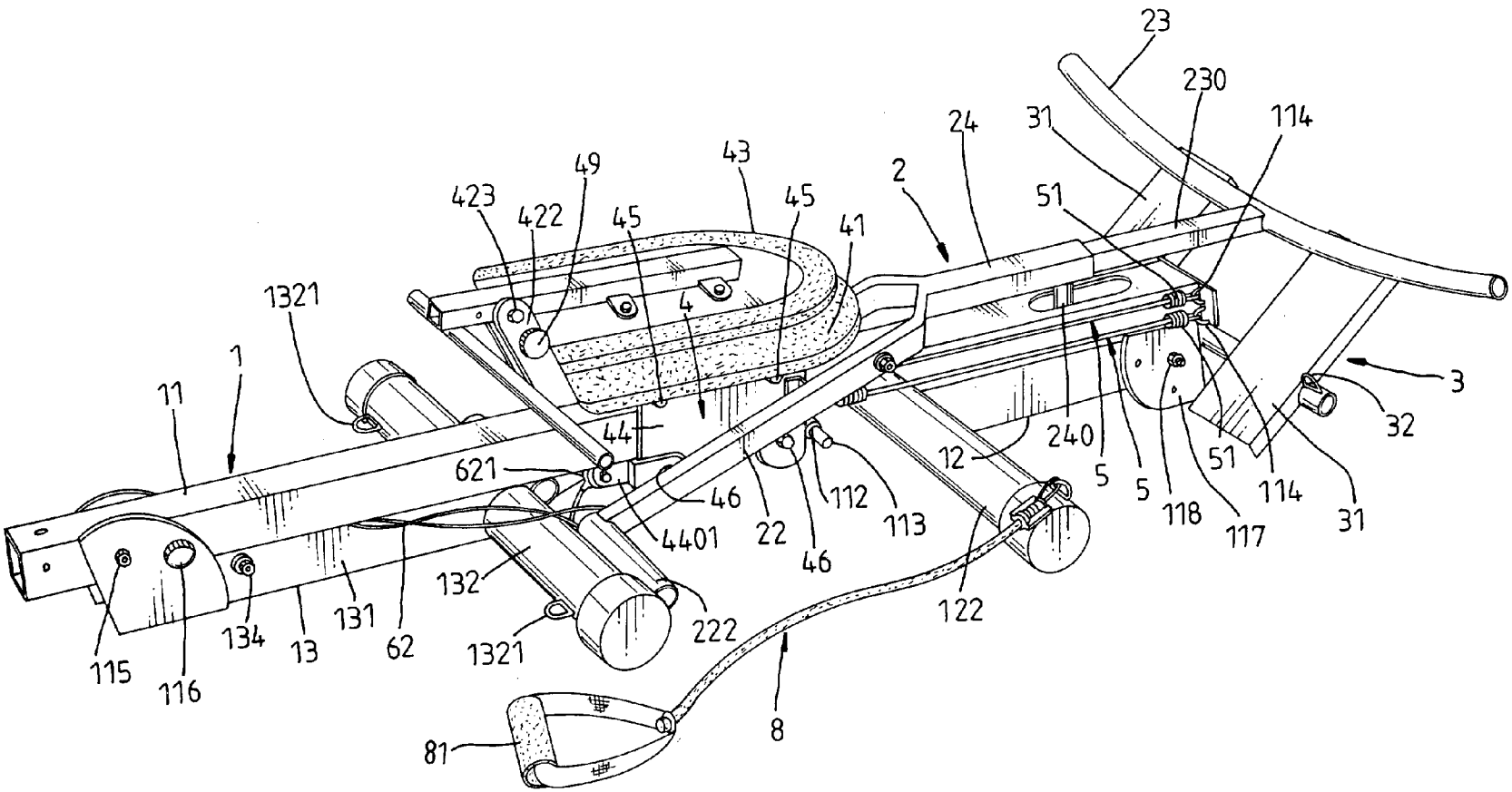
FIG. 8 shows the folding collapsible rowing machine collapsed according to the present invention.
Figure 9:
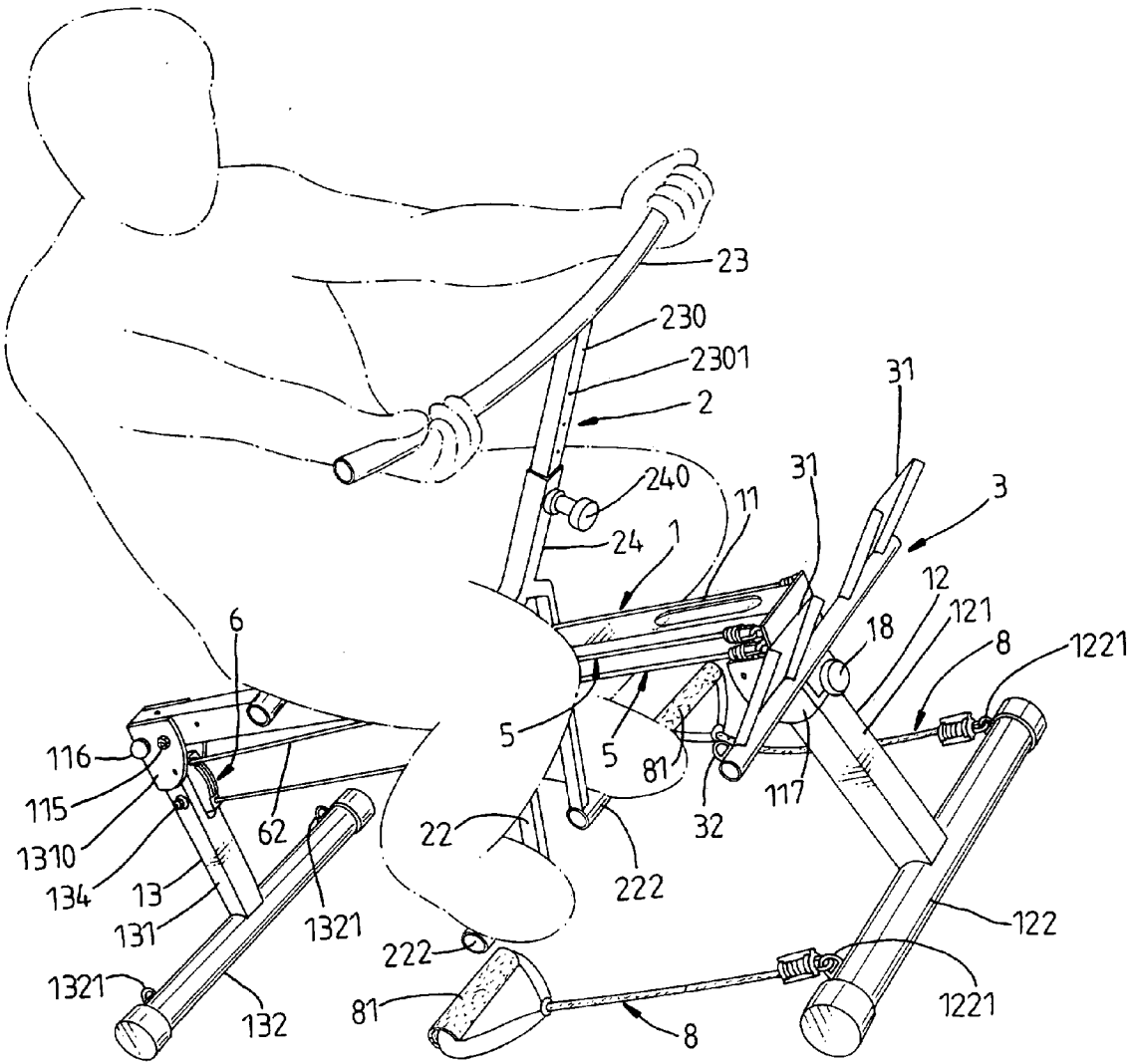
FIG. 9 is a schematic drawing showing one operation status of the present invention.
Figure 10:
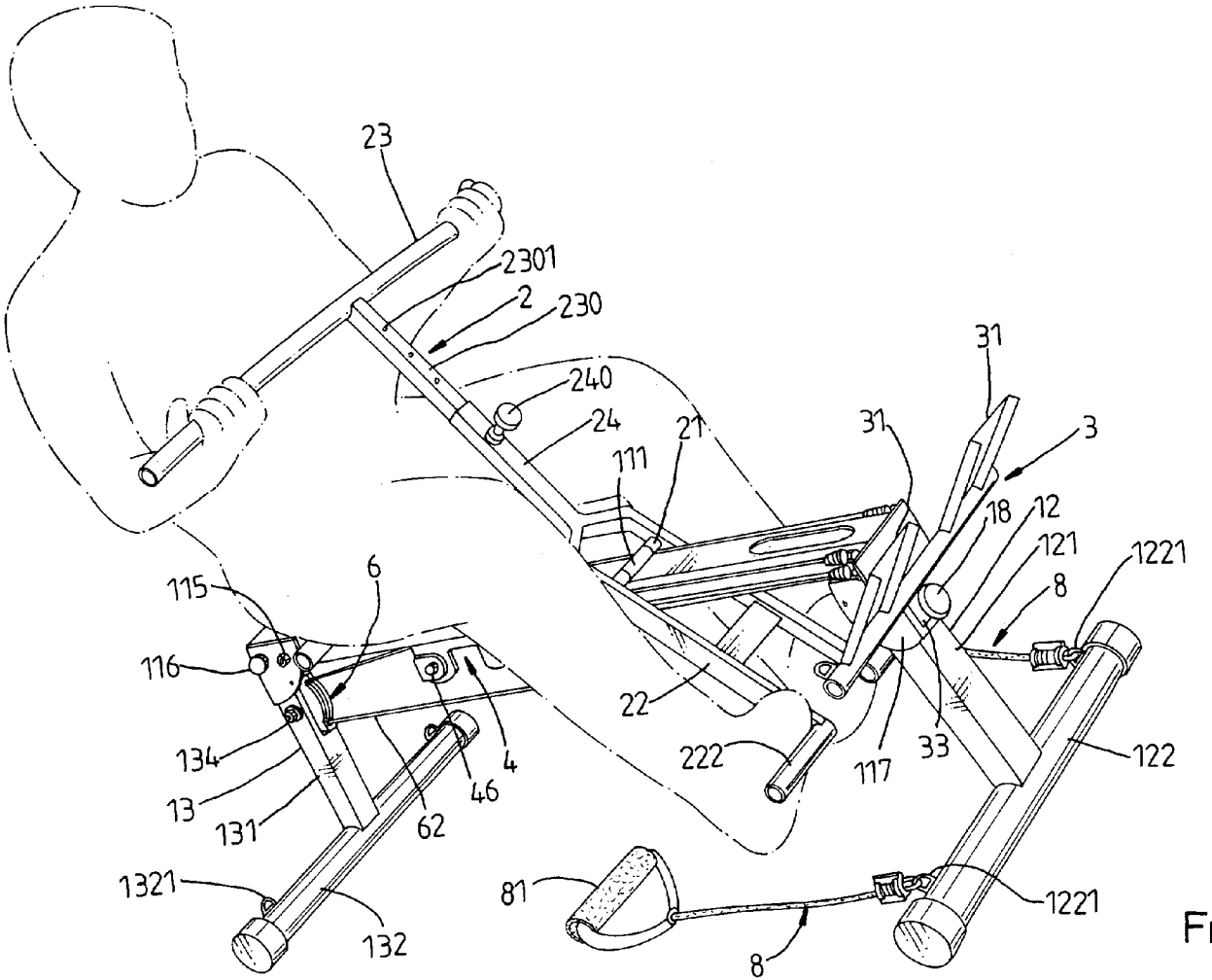
FIG. 10 is a schematic drawing showing another operation status of the present invention.
Figure 11:
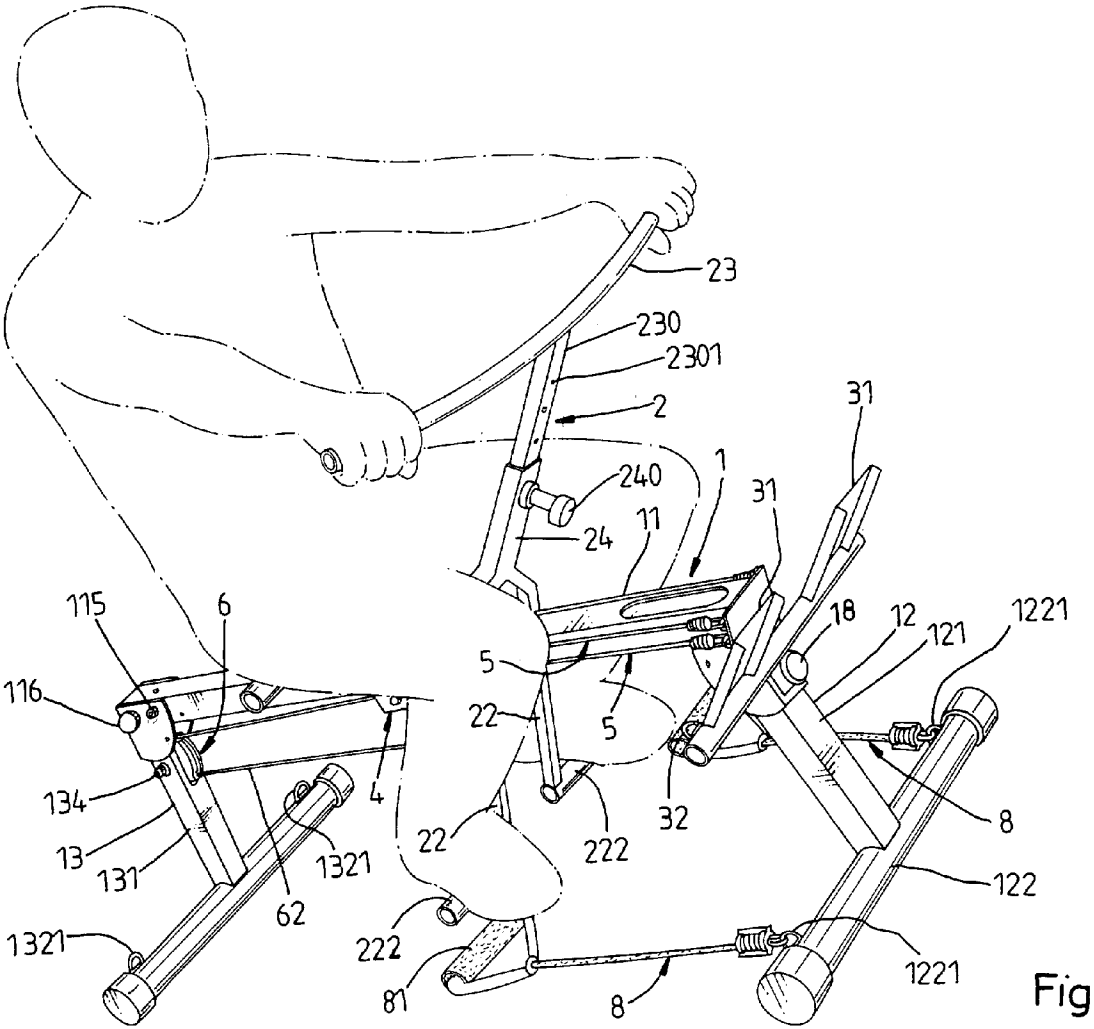
FIG. 11 is a schematic drawing showing still another operation status of the present invention.
Figure 12:
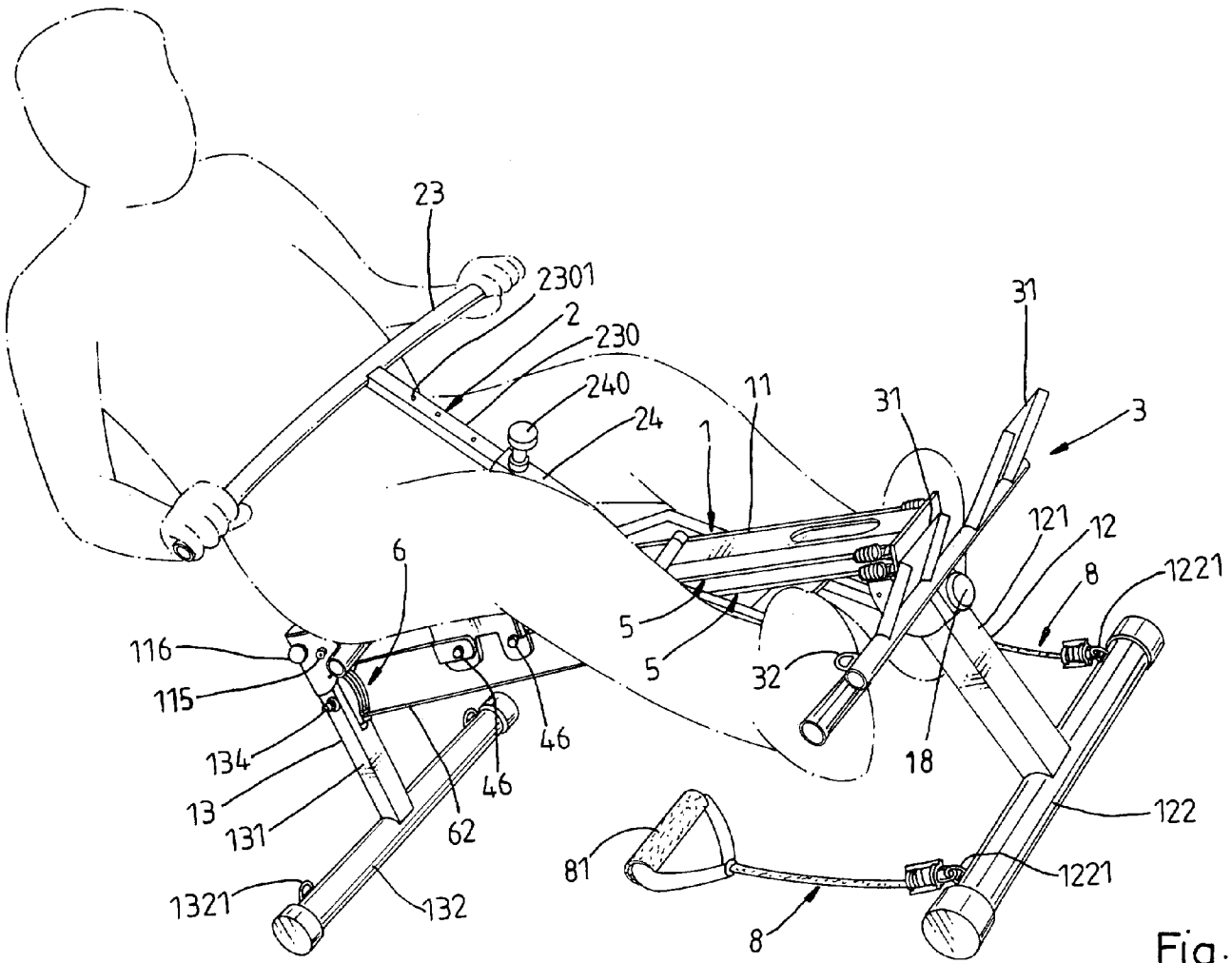
FIG. 12 is a schematic drawing showing still another operation status of the present invention.
Figure 13:
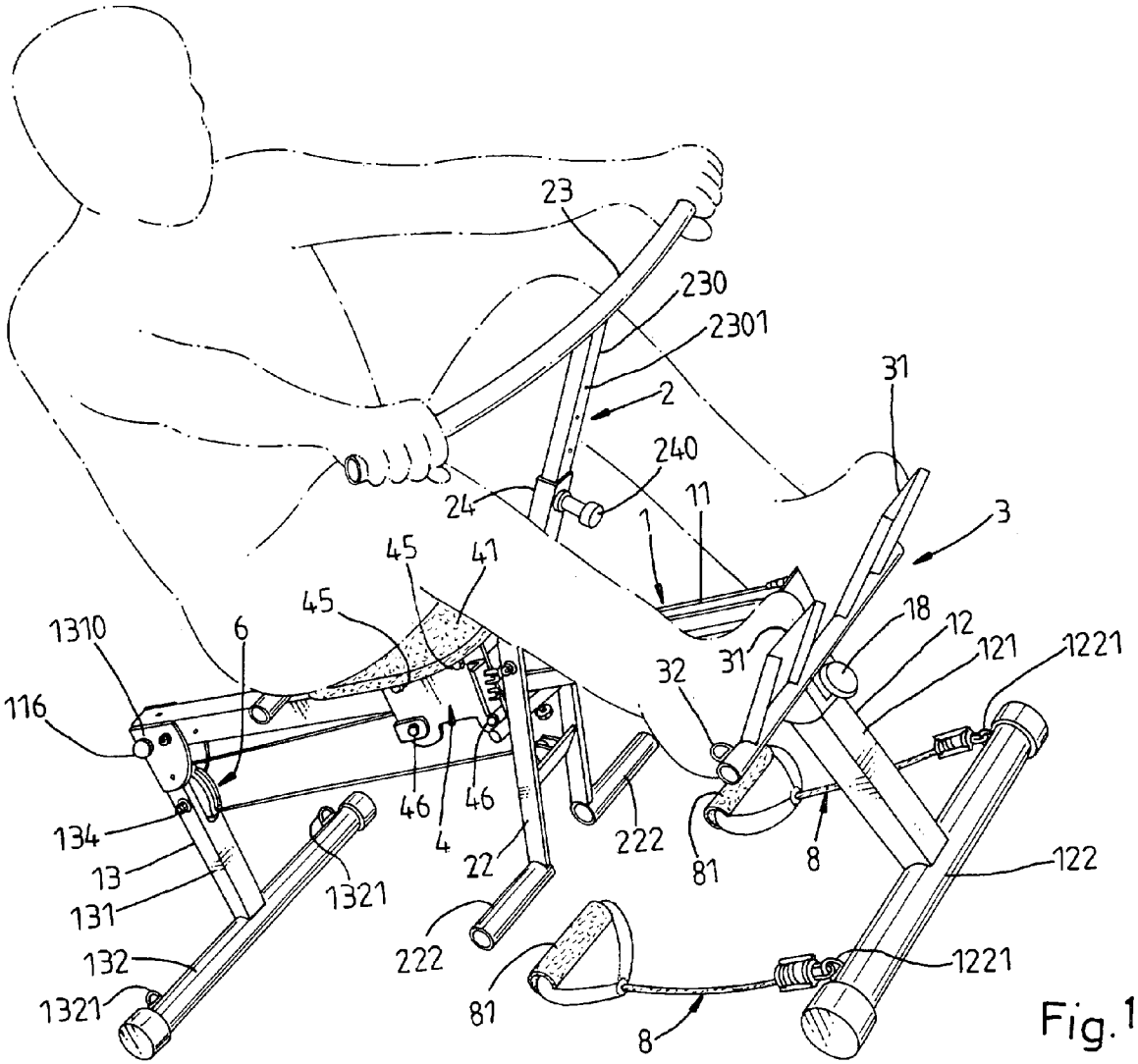
FIG. 13 is a schematic drawing showing still another operation status of the present invention.
Figure 14:
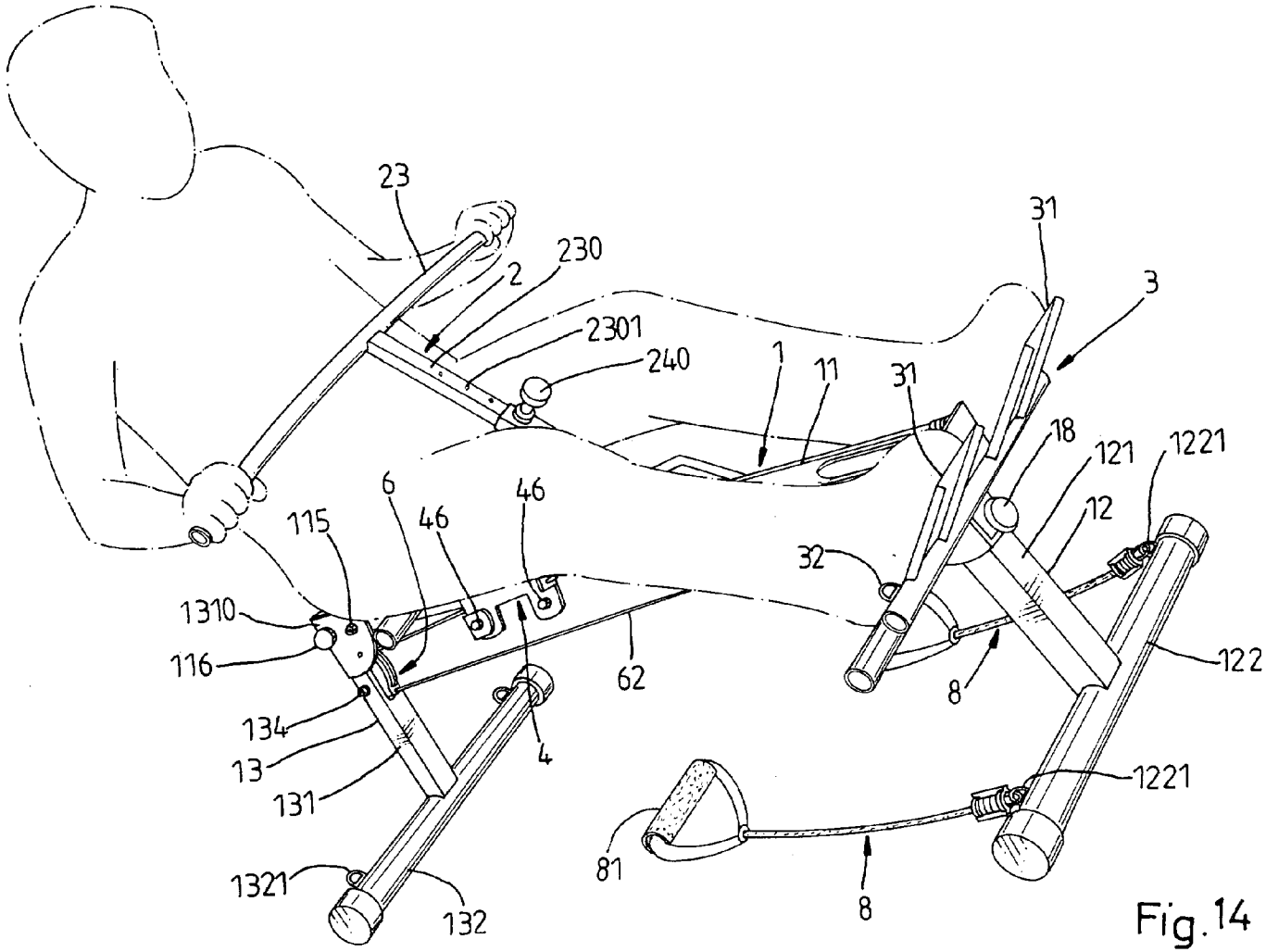
FIG. 14 is a schematic drawing showing still another operation status of the present invention.
Figure 15:
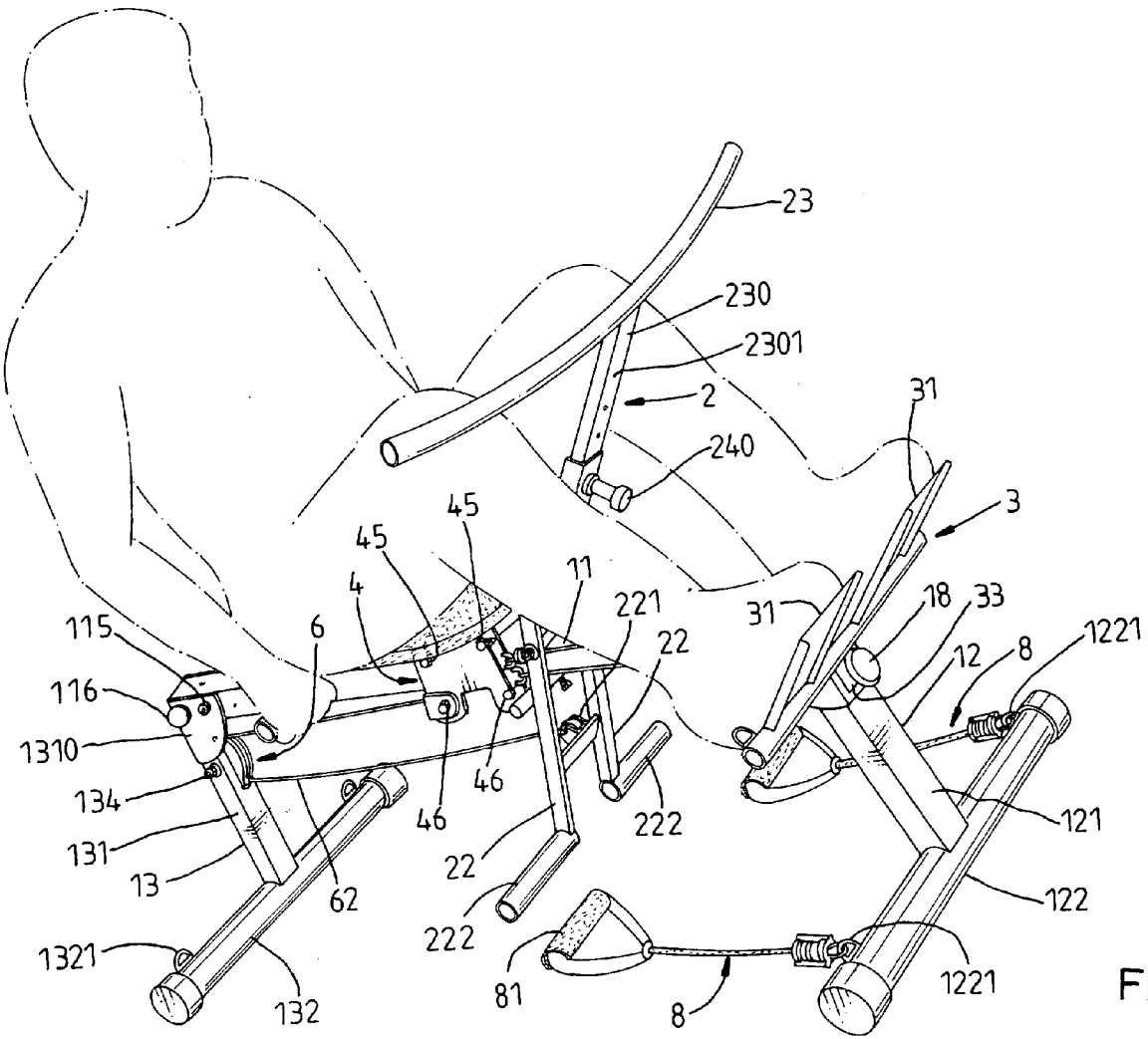
FIG. 15 is a schematic drawing showing still another operation status of the present invention.
Figure 16:
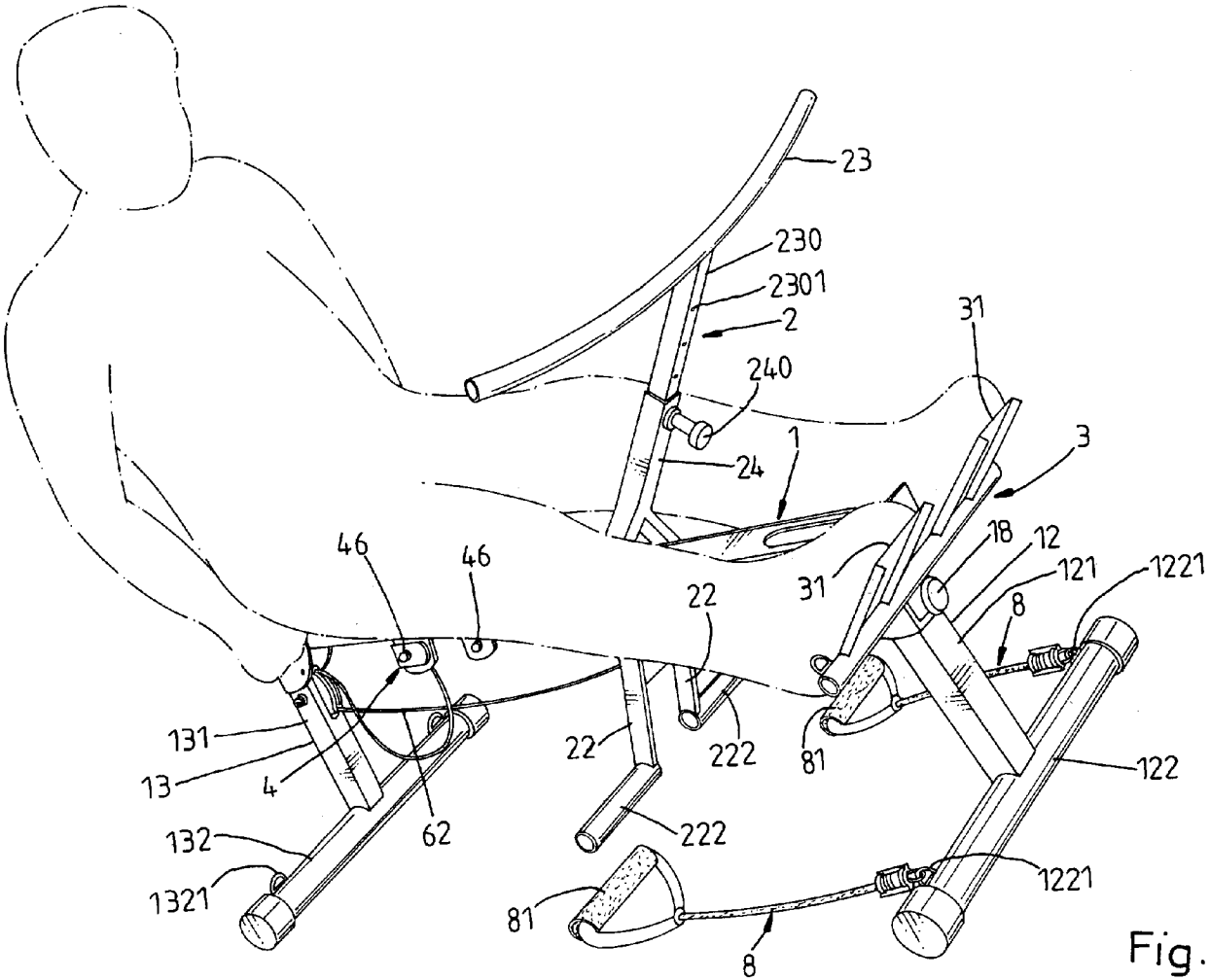
FIG. 16 is a schematic drawing showing still another operation status of the present invention.
Figure 17:
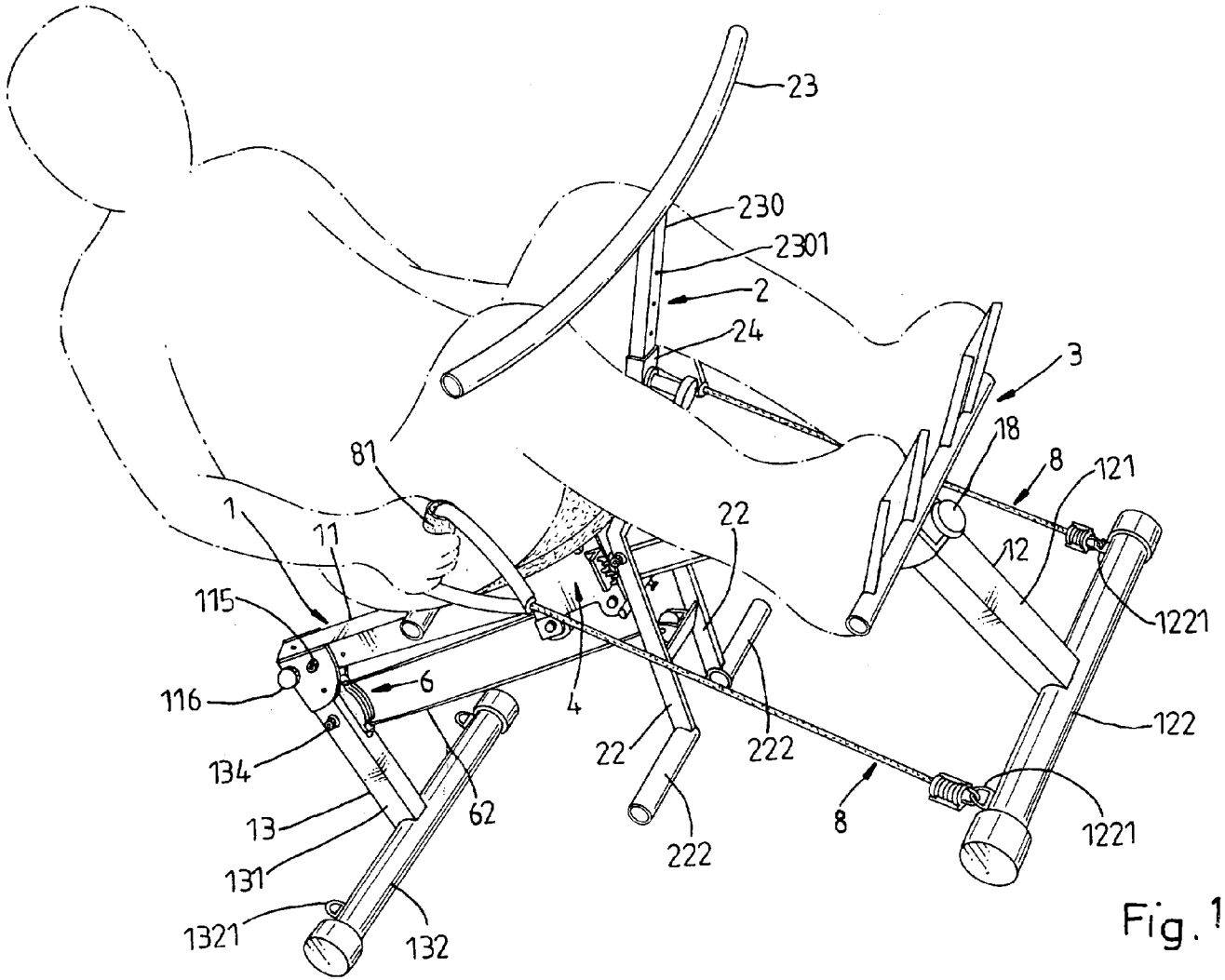
FIG. 17 is a schematic drawing showing still another operation status of the present invention.
Figure 18:
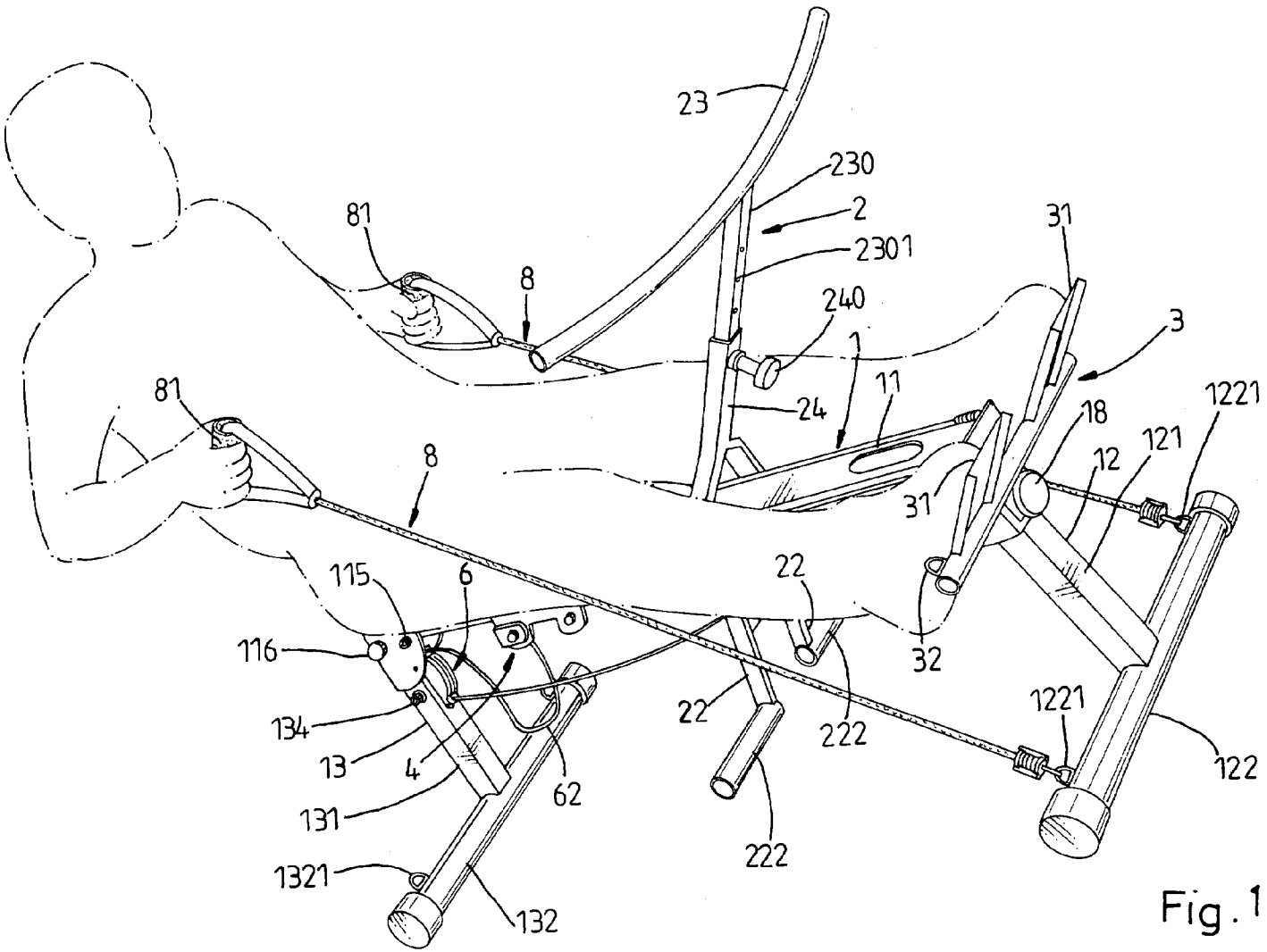
FIG. 18 is a schematic drawing showing still another operation status of the present invention.
Figure 19:
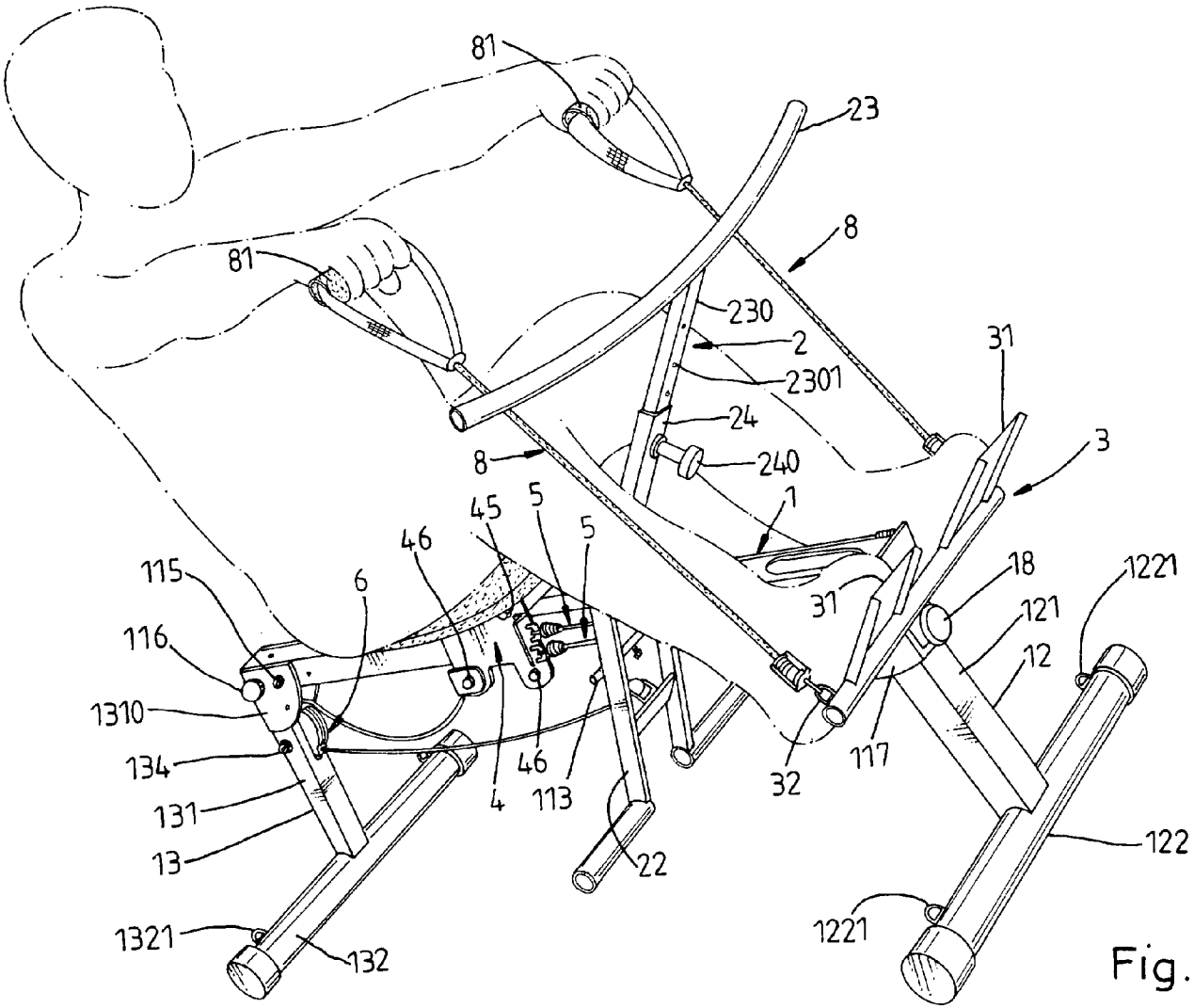
FIG. 19 is a schematic drawing showing still another operation status of the present invention.
Figure 20:
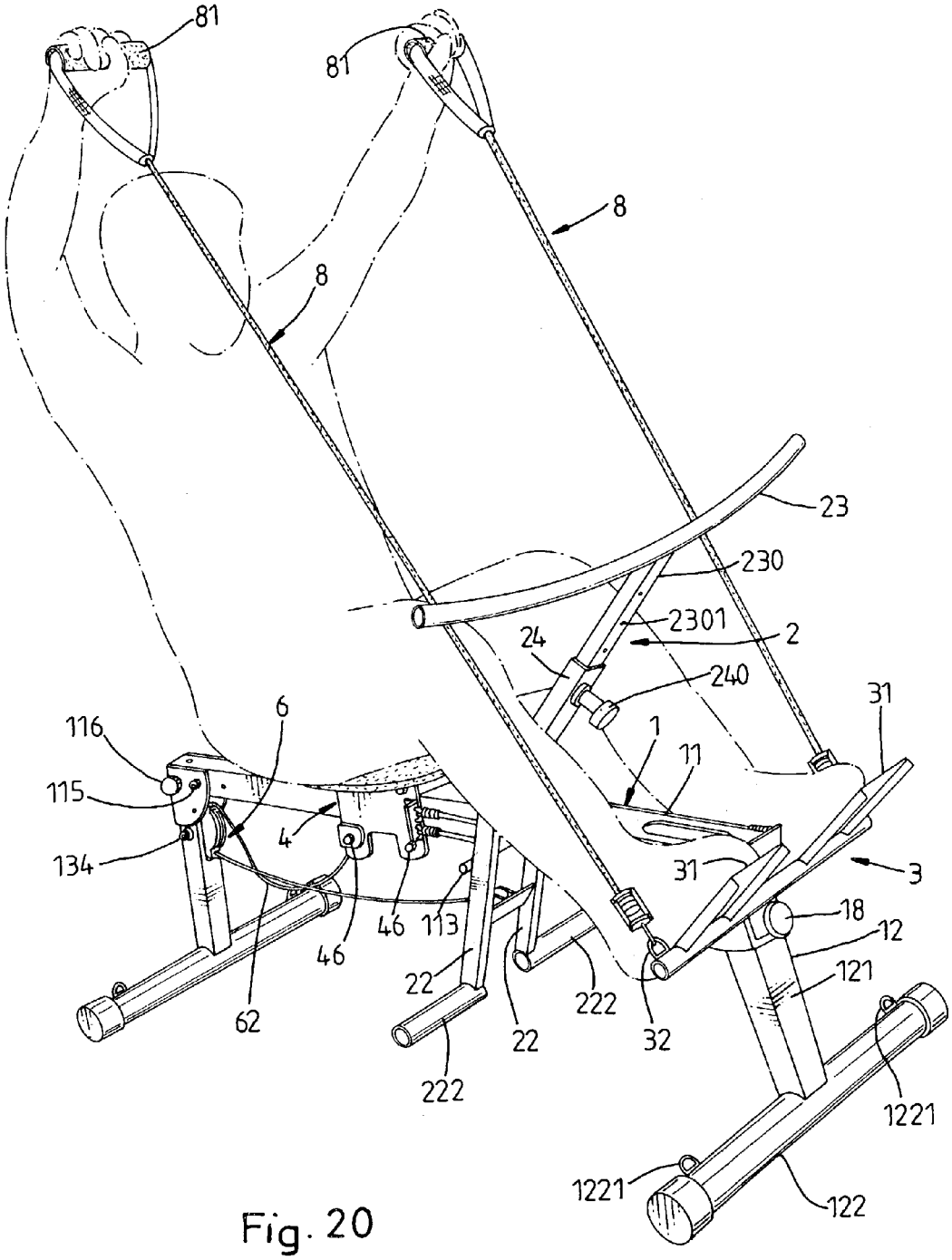
FIG. 20 is a schematic drawing showing still another operation status of the present invention.
Figure 21:
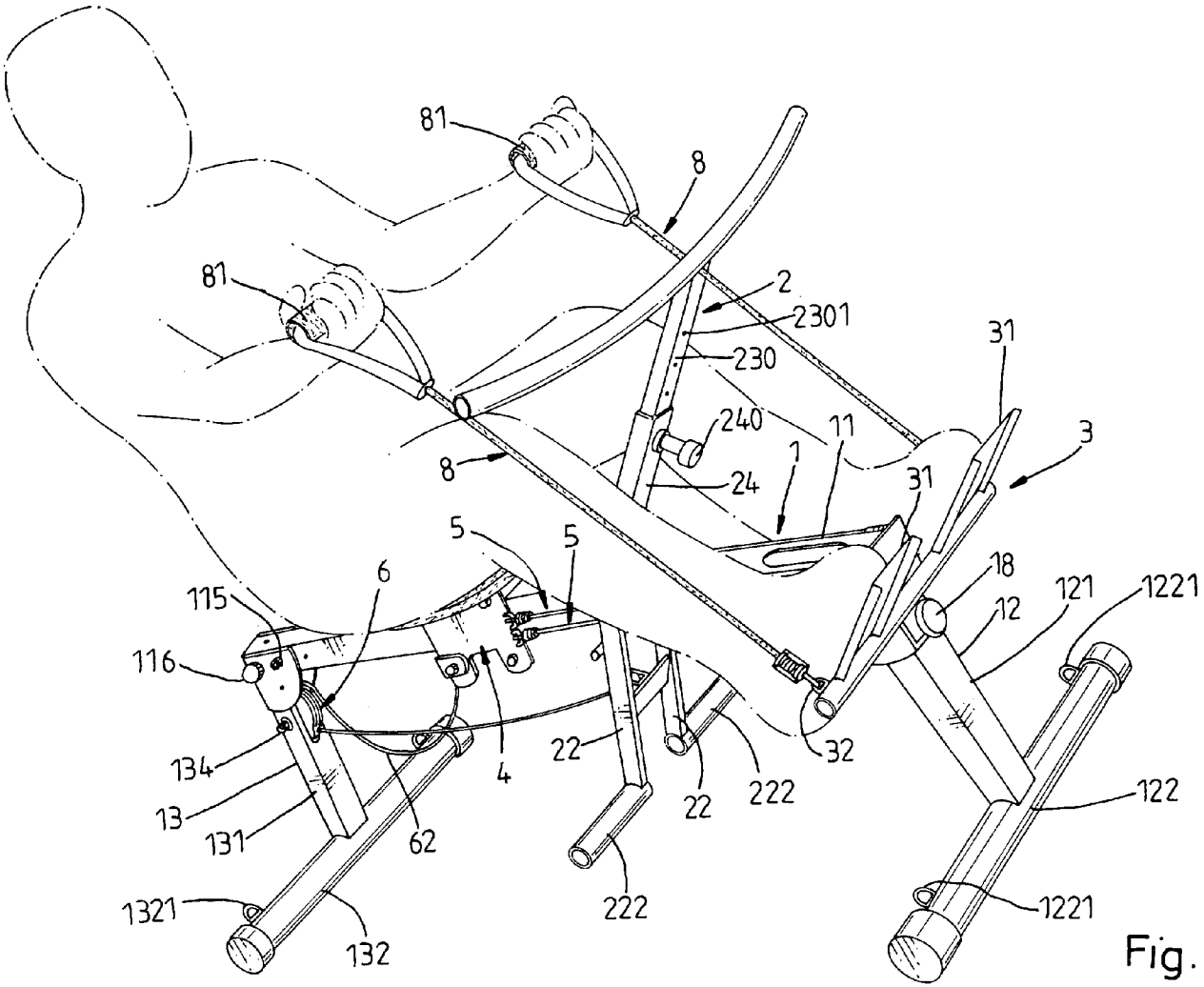
FIG. 21 is a schematic drawing showing still another operation status of the present invention.
Figure 22:
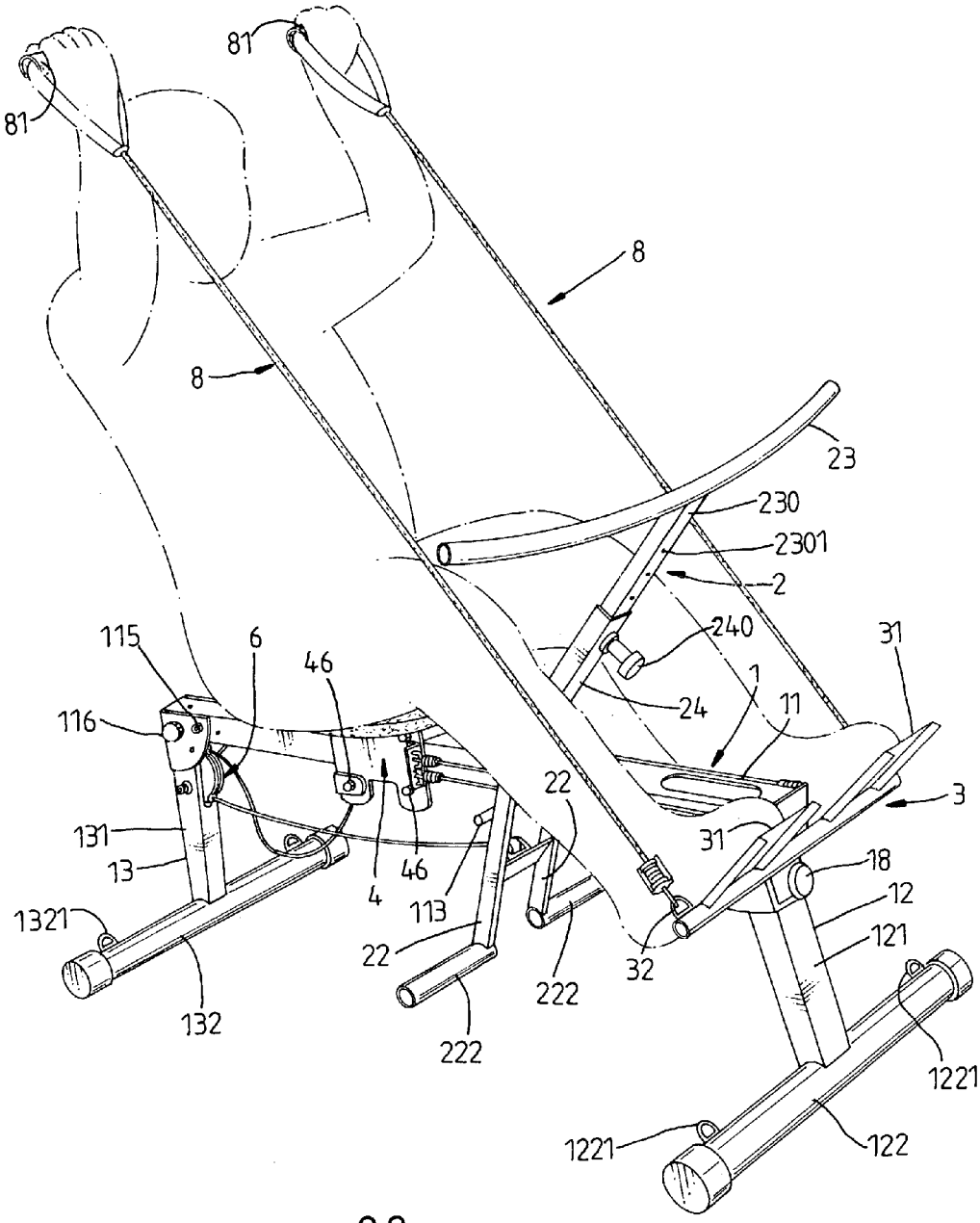
FIG. 22 is a schematic drawing showing still another operation status of the present invention.
Figure 23:
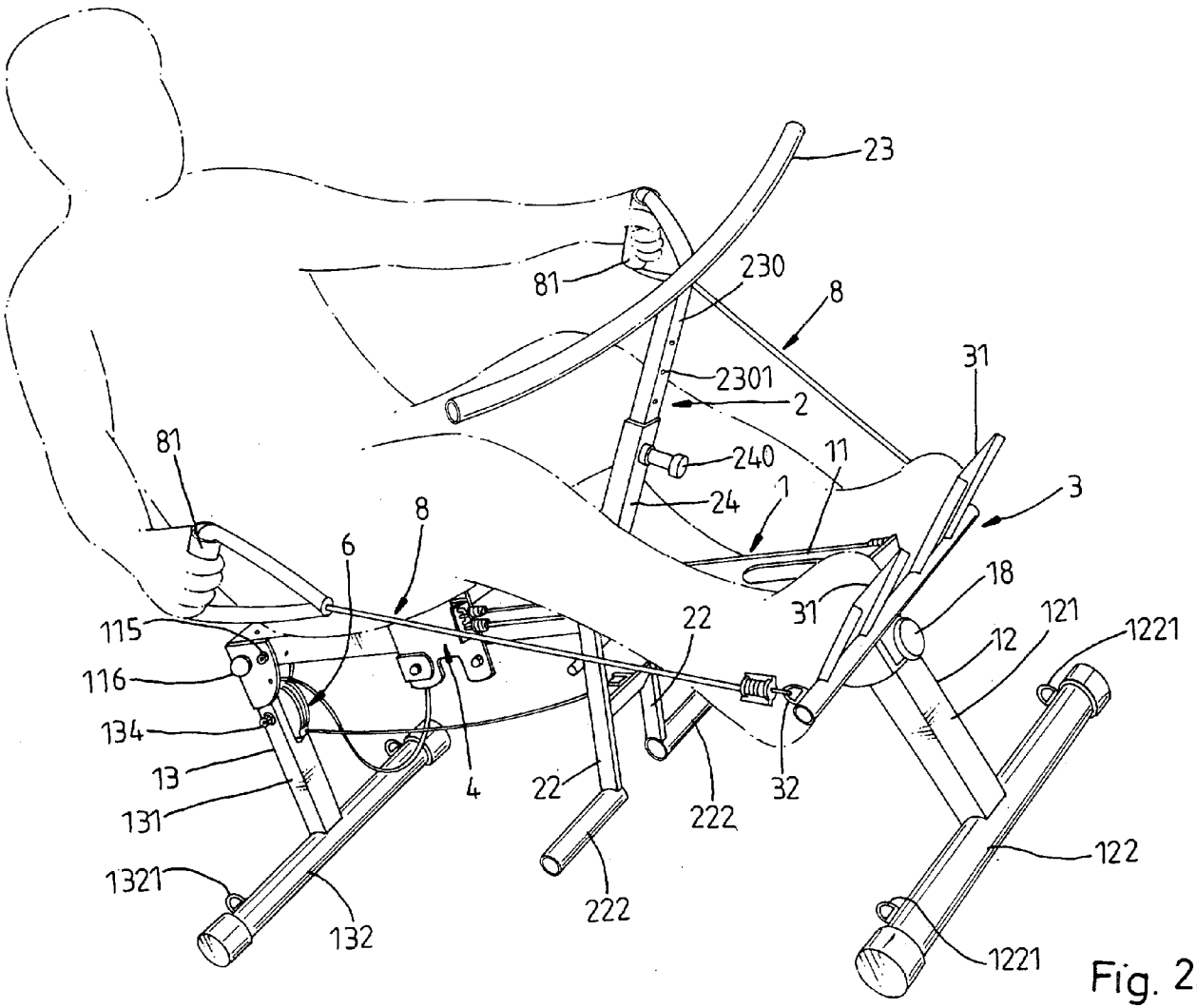
FIG. 23 is a schematic drawing showing still another operation status of the present invention.
Figure 24:
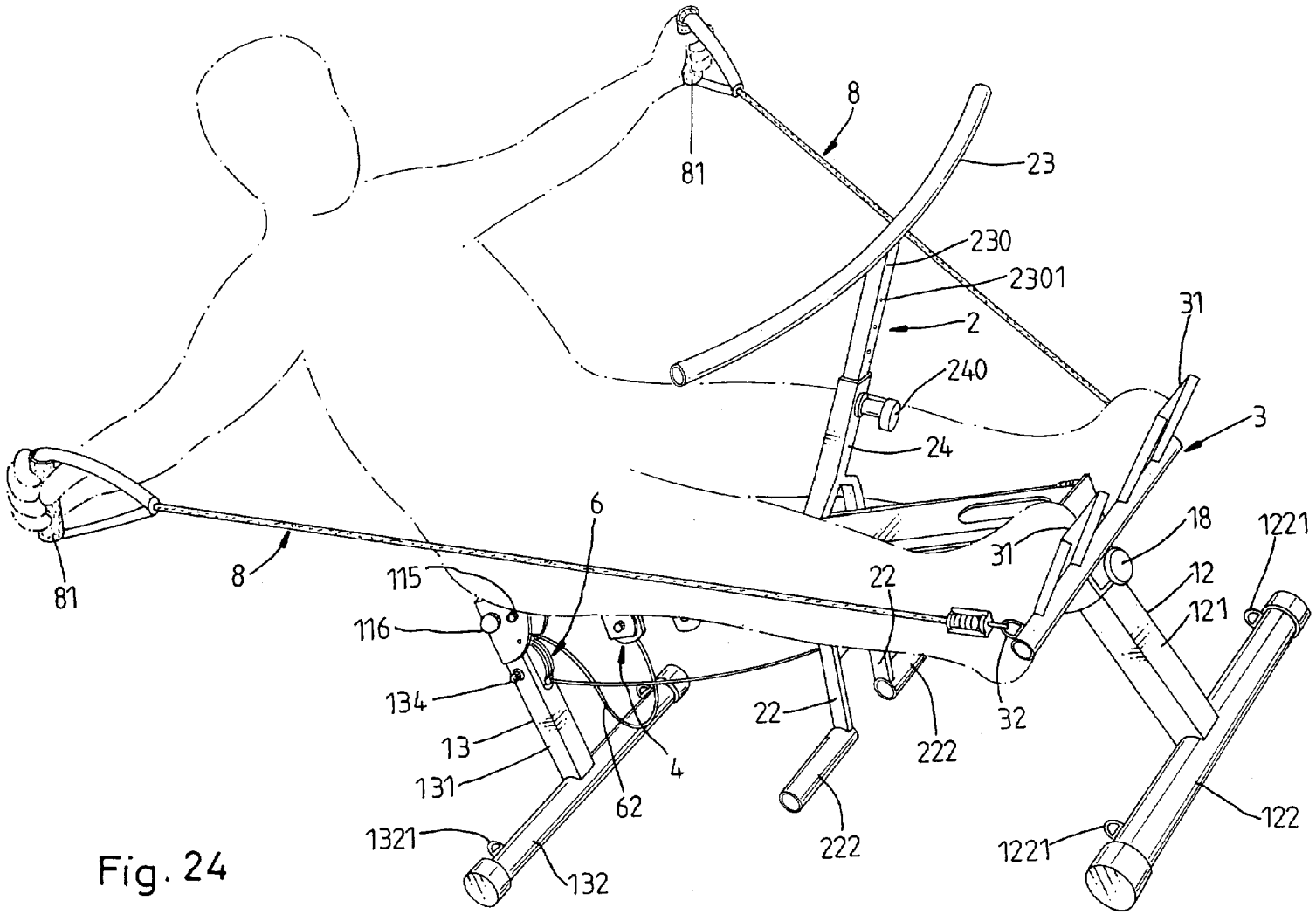
FIG. 24 is a schematic drawing showing still another operation status of the present invention.
Figure 25:
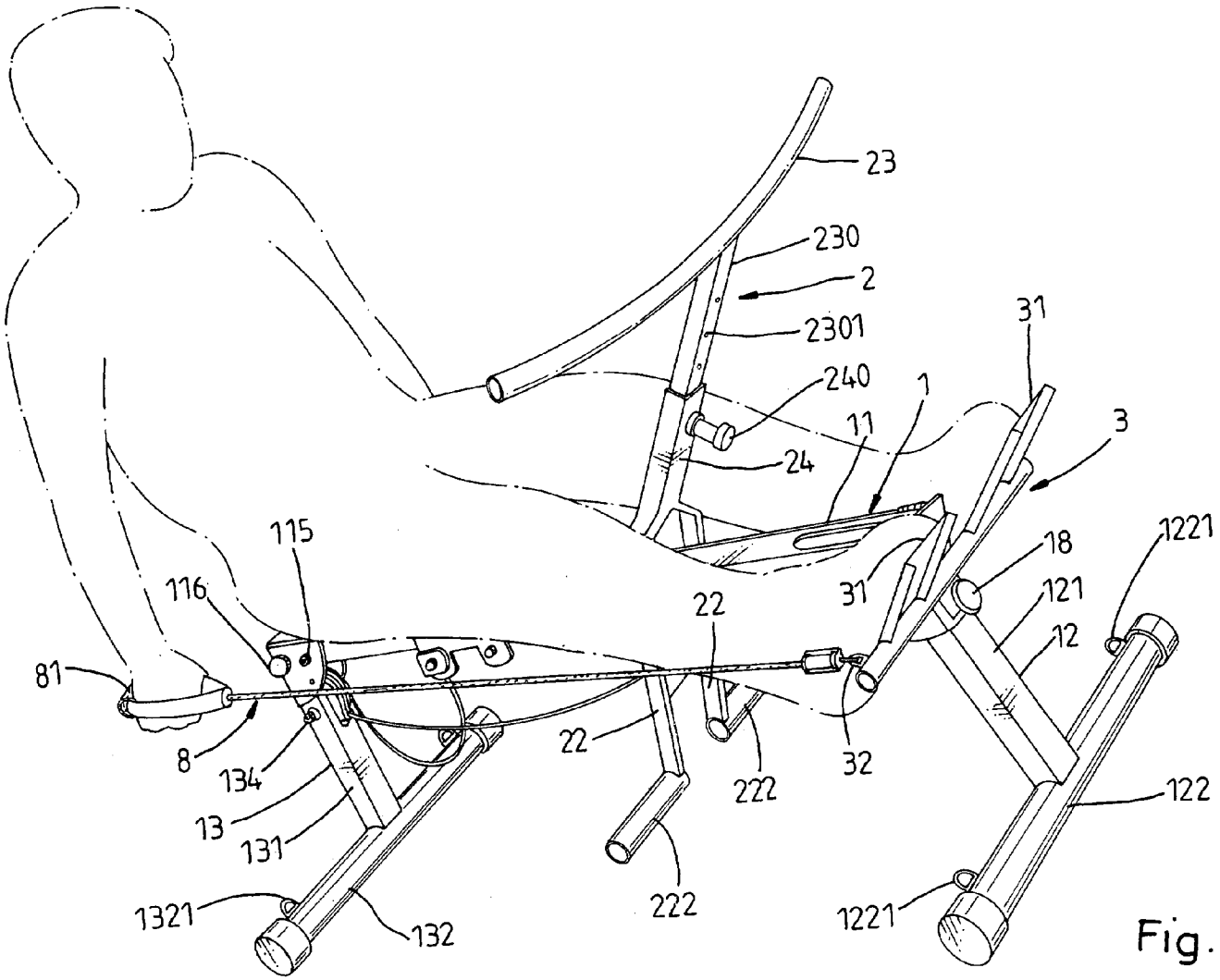
FIG. 25 is a schematic drawing showing still another operation status of the present invention.
Figure 26:
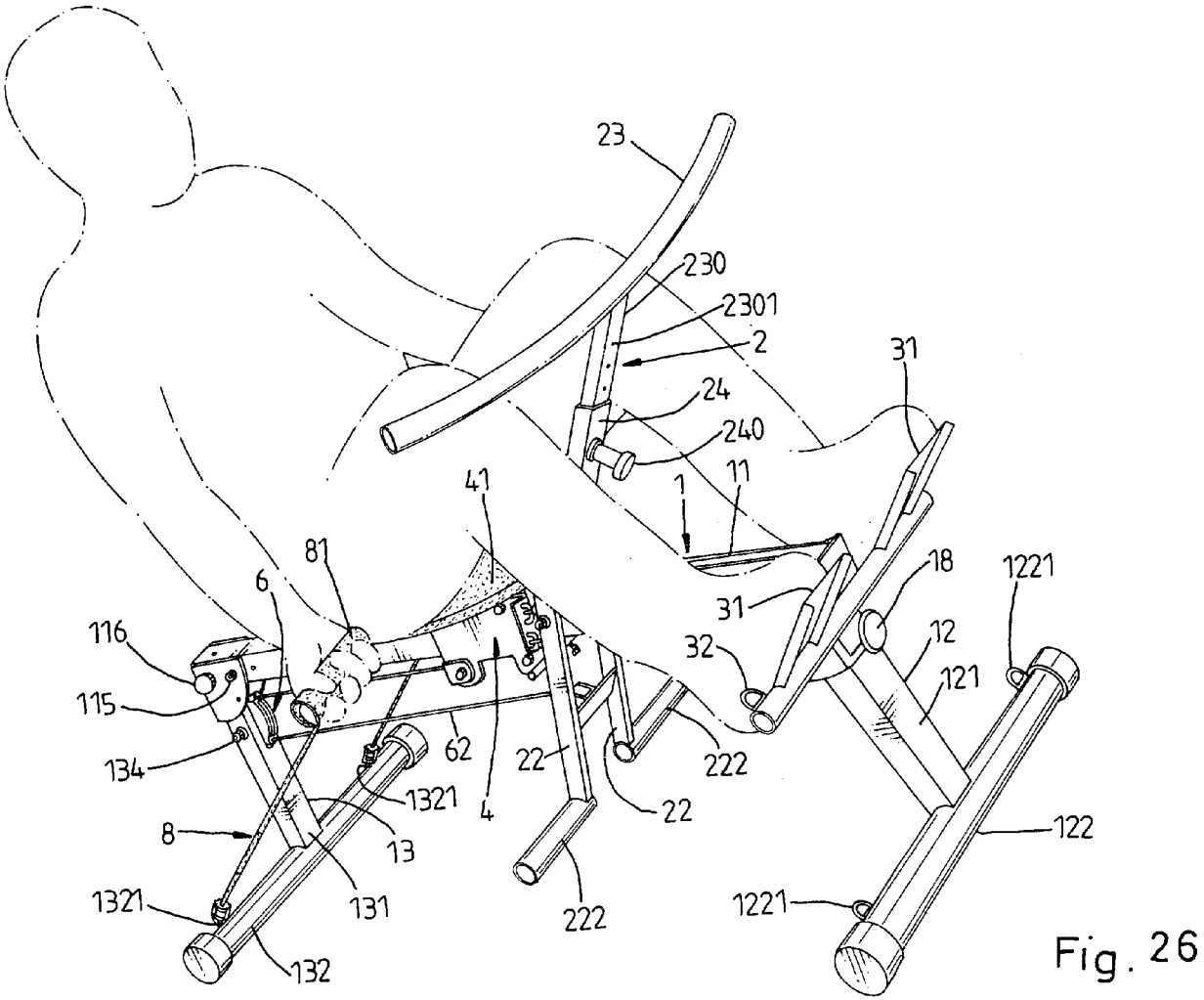
FIG. 26 is a schematic drawing showing still another operation status of the present invention.
Figure 27:
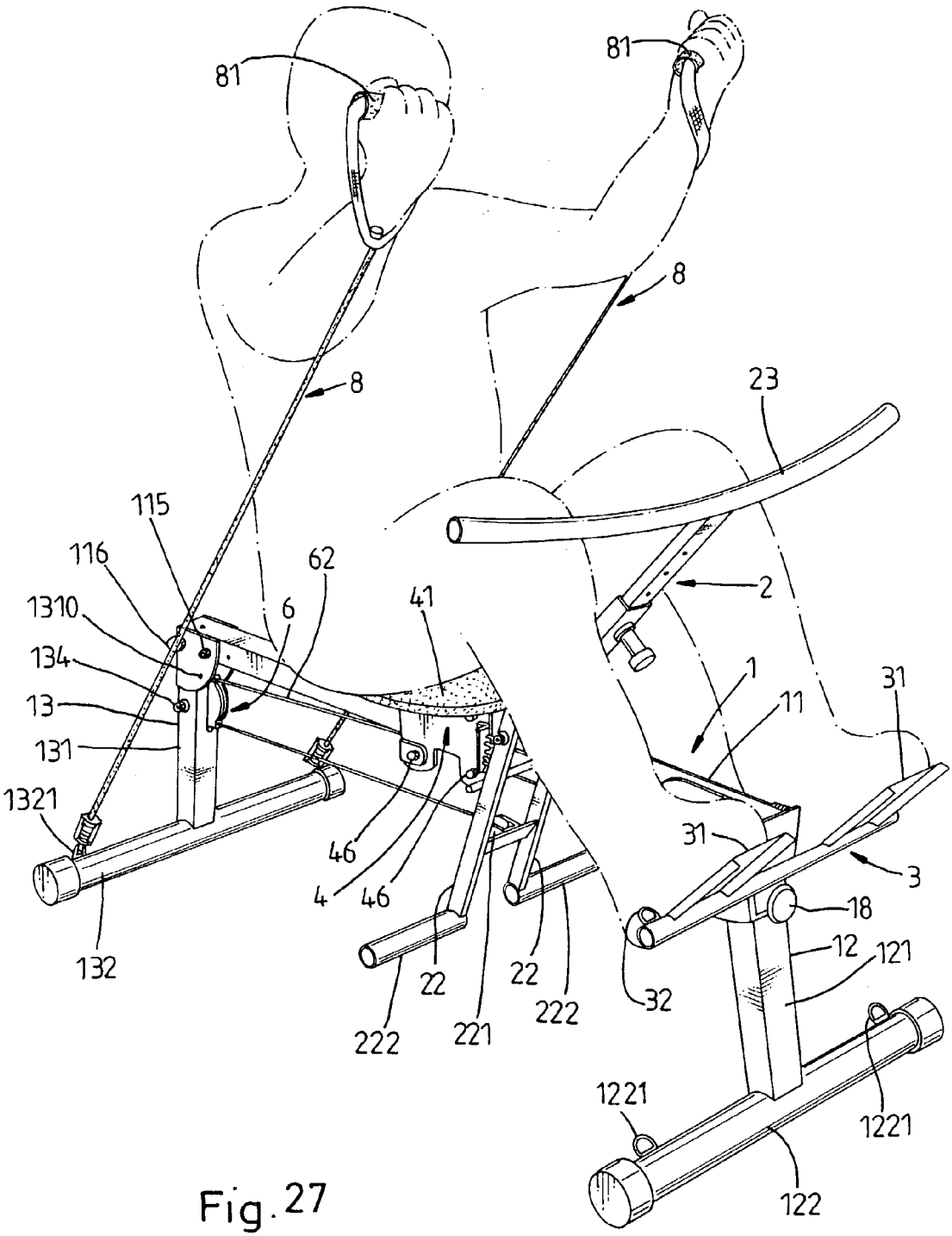
FIG. 27 is a schematic drawing showing still another operation status of the present invention.
Figure 28:
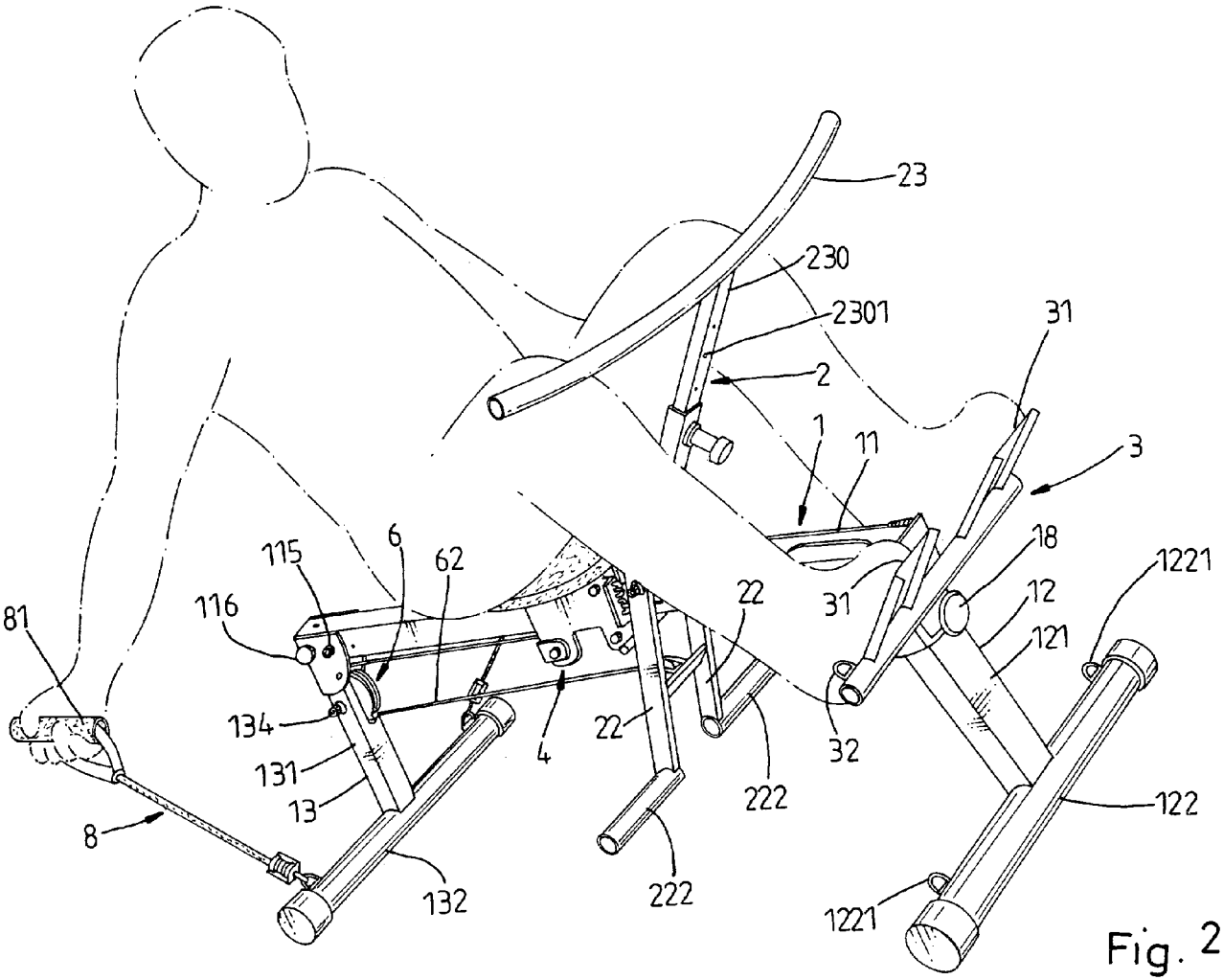
FIG. 28 is a schematic drawing showing still another operation status of the present invention.
Figure 29:
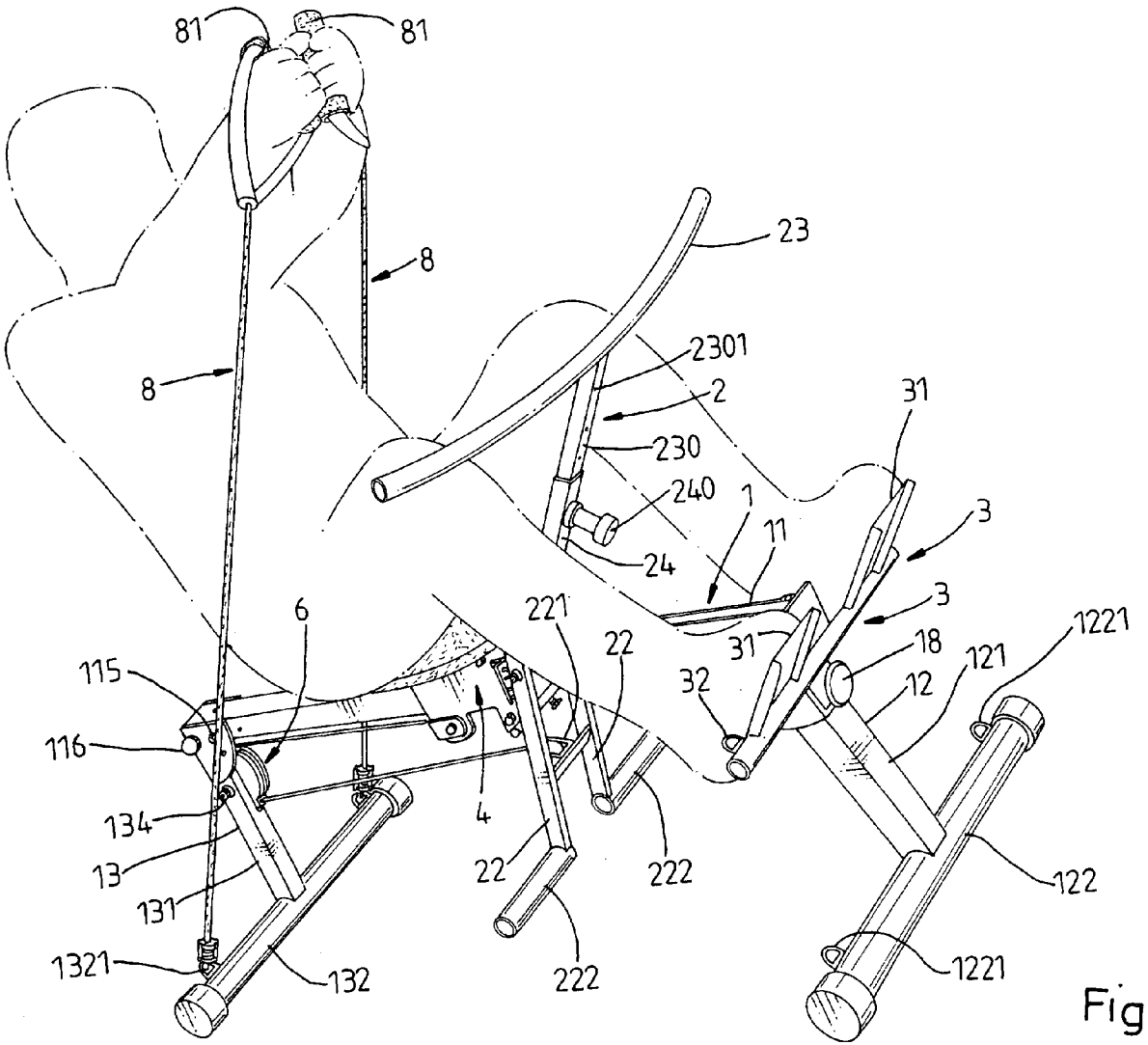
FIG. 29 is a schematic drawing showing still another operation status of the present invention.
Figure 30:
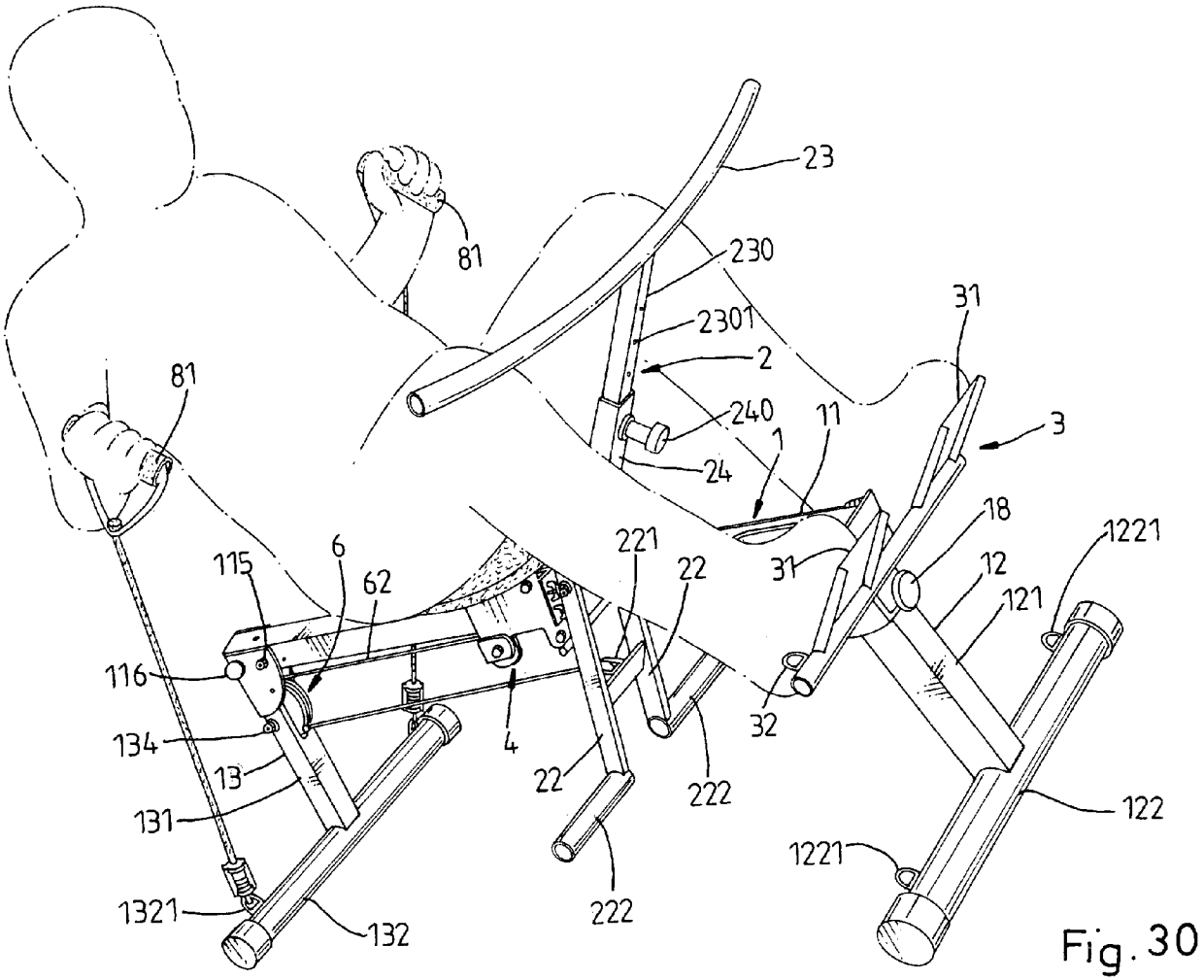
FIG. 30 is a schematic drawing showing still another operation status of the present invention.
Figure 31:
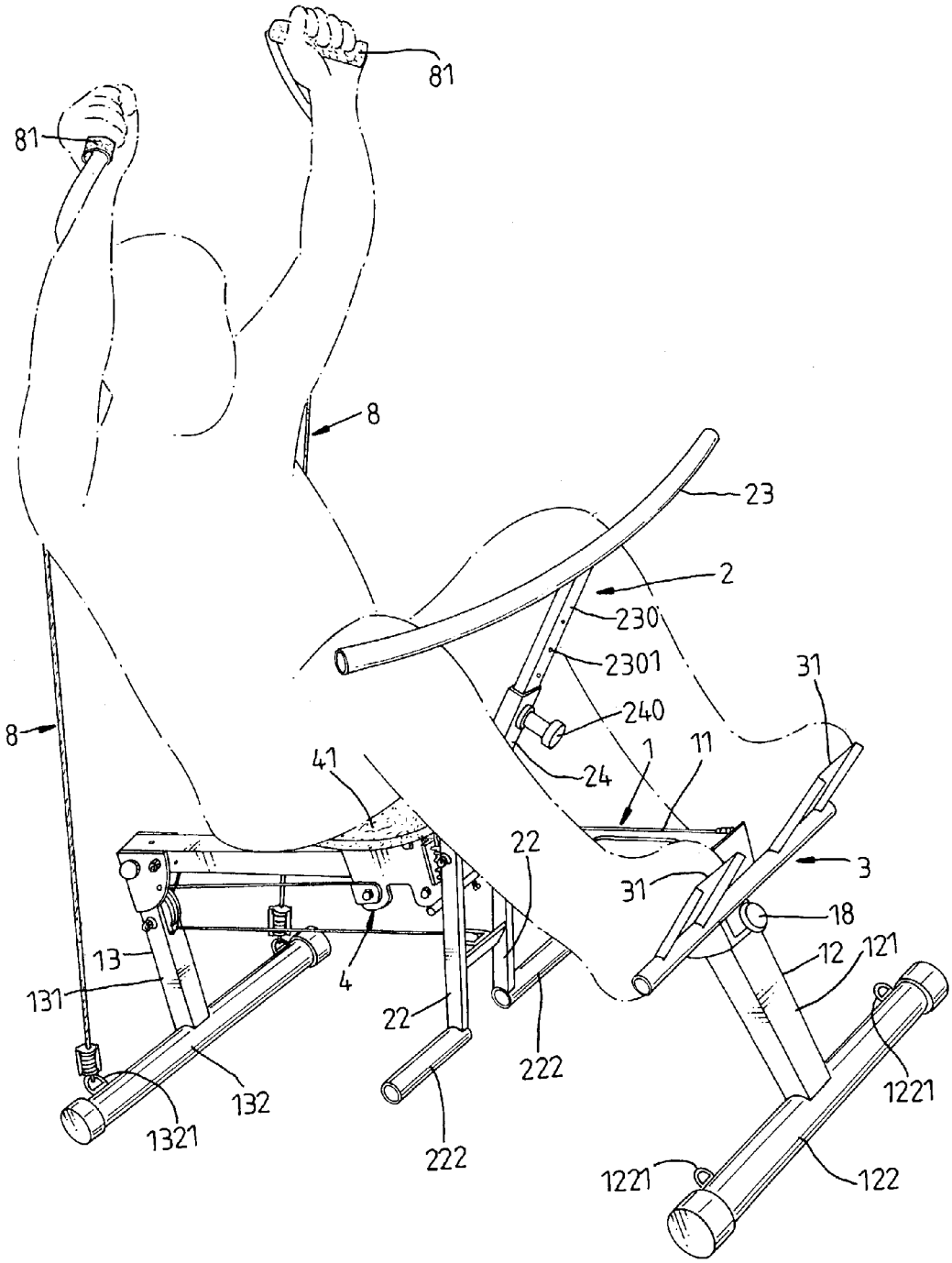
FIG. 31 is a schematic drawing showing still another operation status of the present invention.

The elastic cord members 5 each have a front end 51 respectively fastened to the eyes 114 of the main shaft 11 and a rear end 52 respectively fastened to the front eyes 40 of the sliding seat 4 (see FIGS. 5 and 8).

The aforesaid friction wheel block unit comprises a friction wheel block 6 mounted in the opening 133 and secured to the vertical top bar 131 of the rear support 13 by a screw bolt 134, a friction wheel 61 mounted in the friction wheel block 6 and turnable about the screw bolt 134, and a drag rope 62 mounted on the periphery of the friction wheel 61 and extended out of horizontal top and bottom holes 611 and 612 of the friction wheel block 6, having two distal ends 621 and 622 respectively fastened to the pivot 4402 at the lugs 440 of the sliding seat 4 and the transverse frame 221 of the rocker 2.

When in use, the user can sit on the seat cushion 41 and rested with the back on the back cushion 43, and then hold the handlebar 23 of the rocker 2 with the hands and rest the feet on the foot bars 222 (see FIGS. 9~12), and then row the rocker 2 to alternatively stretch and release the drag rope 62, and at the same time the sliding seat 4 is alternatively moved forwards and backwards along the main shaft 11 of the base frame 1. During operation, the elastic cord members 5 impart a damping resistance to the user. This operation method enables the muscles of the user's hands, chest, abdomen, and legs to be exercised. The user can also rest the feet on the footplates 31 of the foot frame 3 (see FIGS. 13 and 14) and then swing the rocker 2 with the hands. In still another operation mode, the user can hold the horizontal handlebar 421 of the sliding seat 4 with the hands and rest the feet on the footplates 31 of the foot frame 3, and then stretch and release the legs to move the sliding seat 4 alternatively forwards and backwards along the main shaft 11 of the seat frame 1 (see FIGS. 15 and 16). The user can also fasten two elastic pull ropes 8 to the eyes 1221 of the front support 12 (see FIGS. 17 and 18) or to the eyes 32 of the foot frame 3 (see FIGS. 19~25) or to the eyes 1321 of the rear support 13 (see FIGS. 26~31), and rest the feet on the footplates 31 of the foot frame 3 with the hand holding the handles 81 of the elastic pull ropes 8, and then alternatively stretch and release the elastic pull ropes 8, causing the sliding seat 4 to be alternatively moved forwards and backwards along the main shaft 11 of the base frame 1.

The main shaft 11 has a rear end pivotally connected to a top lug 1310 of the vertical top bar 131 of the rear support 13 by a pivot 115, and a front end terminating in a mounting frame 117, which is pivoted to the vertical top bar 121 of the front support 12 by a pivot 118 (see FIG. 8). An adjustment knob 18 is provided having a threaded shank 181 threaded into a screw hole 332 in a lug 33 of the foot frame 3 and a screw hole 1172 in the mounting frame 117 and a screw hole 1212 in the vertical top bar 121 of the front support 12 (see FIG. 7). Rotating the adjusting knob 18 adjusts the tension of the elastic cord members 5. Further, a lock pin 116 is fastened to the top lug 1310 and the rear end of the main shaft 11 to lock the main shaft 11 in the operative position.

The back cushion 43 is fixedly mounted on a back support 48, which is pivoted to an upright lug 422 at the horizontal handlebar 421 by a pivot 423, and locked by a lock pin 49 (see FIG. 5).

The handlebar 23 of the rocker 2 has a bottom extension bar 230 perpendicularly downwardly extended from the middle part thereof. The bottom extension bar 230 is axially slidably inserted into a hollow top shank 24 at the top side of the bottom fork 22, having a plurality of locating holes 2301 longitudinally aligned in a line. A spring-supported lock bolt 240 is mounted in the top shank 24 and selectively inserted into one of the locating holes 2301 to lock the handlebar 23 at the desired elevation.

When not in use, the lock pin 49 is removed from the sliding seat 4 for enabling the sliding seat 4 to be turned forwardly downwards and closely attached to the top side of the main shaft 11 of the base frame 1, and then the locating rod 113 is removed from the transverse locating hole 112 for enabling the rocker 2 to be turned forwardly downwards and closely attached to the top side of the main shaft 11 of the base frame 1, and then the lock pin 116 is removed from the main shaft 11 and rear support 13 of the base frame 1 for enabling the rear support 13 to be turned forwardly upwards and closely attached to the bottom side of the main shaft 11 of the base frame 1, and then the knob 18 is unfastened for enabling the front support 12 to be turned backwardly upwards and closely attached to the bottom side of the main shaft 11 of the base frame 1. When the rowing machine collapsed, it occupies less storage space. Further, the user can also pull the spring-supported lock bolt 240 backwards from the from the bottom extension bar 230, enabling the handlebar 23 to be separated from the rocker 2.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A folding collapsible rowing machine comprising:

a base frame, said base frame comprising a front support, a rear support, and a main shaft horizontally supported between said front support and said rear support, said front support comprising a horizontal bottom bar and a vertical top bar perpendicularly upwardly extended from a middle part of the horizontal bottom bar and adapted to support one end of said main shaft horizontal bottom bar of said front support having two eyes protruded from the periphery thereof near two ends, said rear support comprising a horizontal bottom bar and a vertical top bar perpendicularly upwardly extended from a middle part of the horizontal bottom bar, the horizontal bottom bar of said rear support having two eyes protruded from the periphery thereof near two ends, the vertical top bar of said rear support having an opening, said main shaft comprising a barrel transversely located on a top side thereof, a transverse locating hole, a locating rod mounted in said transverse locating hole, and a plurality of front eyes symmetrically bilaterally provided at a front end thereof above said front support;

a rocker coupled to said main shaft of said base frame, said rocker comprising a bottom fork, a transverse frame transversely suspended in said bottom fork and spaced below said main shaft of said base frame, two barrels aligned in said bottom fork and pivotally connected to two distal ends of the barrel of said main shaft by a pivot bolt, two foot bars respectively outwardly extended from two bottom ends of said bottom fork, and a handlebar provided at a top side of said bottom fork;

a foot frame fixedly fastened to the vertical top bar of said front support, said foot frame comprising two footplates and two eyes symmetrically disposed at two sides;

a sliding seat movable along said main shaft of said base frame, said sliding seat comprising a seat frame, a plurality of rollers symmetrically pivoted to said seat frame at two sides by respective pivots and rotatably supporting said seat frame on said main shaft of said base frame, a plurality of front eyes at a front side of said seat frame, a seat cushion at a top side of said seat frame for sitting, a back frame at a back side of said seat cushion, a back cushion supported on said back frame, a horizontal handlebar located on a bottom side of said back frame, two lugs at two sides of said seat frame, and a pivot fastened to the lugs of said sliding seat;

a plurality of elastic cord members, said elastic cord members each having a front end respectively fastened to the eyes of said main shaft of said base frame and a rear end respectively fastened to the front eyes of said sliding seat; and a friction wheel block unit, said friction wheel block unit comprising a friction wheel block mounted in the opening of said rear support of said base frame and secured to the vertical top bar of said rear support by a screw bolt, a friction wheel mounted in said friction wheel block and turnable about the screw bolt in said friction wheel block, and a drag rope mounted on the periphery of said friction wheel, said drag rope having two distal ends respectively fastened to the pivot at the lugs of said sliding seat and the transverse frame of said rocker.

2. The folding collapsible rowing machine as claimed in claim 1, wherein said foot frame has a screw hole; the vertical top bar of said front support has a screw hole; said main shaft has a rear end pivotally connected to the vertical top bar of said rear support of said base frame by a pivot and locked by a detachable lock pin, and a front end terminating in a front mounting frame pivoted to the vertical top bar of said front support by a pivot, said front mounting frame having a screw hole mounted with an adjustment knob, said adjustment knob having a threaded shank threaded into the screw hole of said foot frame and the screw hole of said mounting frame and the screw hole of the vertical top bar of said front support.

3. The folding collapsible rowing machine as claimed in claim 1, wherein the horizontal handlebar of said sliding seat comprises an upright lug on the middle; said back cushion comprises a back support pivoted to the upright lug of the horizontal handlebar of said sliding seat by a pivot and locked by a lock pin.

4. The folding collapsible rowing machine as claimed in claim 1, wherein the handlebar of said rocker comprises a bottom extension bar perpendicularly downwardly extended from a middle part thereof and axially movably coupled to said bottom fork, said bottom extension bar having a plurality of locating holes longitudinally aligned in a line; said bottom fork of said sliding seat comprises a hollow top shank adapted to receive said bottom extension bar, and a spring-supported lock bolt mounted in said top shank and selectively inserted into one of the locating holes of said bottom extension bar to lock the handlebar of said sliding seat at the desired elevation.

* * * * *